US011118768B2

(12) United States Patent
Danesh

(10) Patent No.: US 11,118,768 B2
(45) Date of Patent: Sep. 14, 2021

(54) OUTER CASING FOR A RECESSED LIGHTING FIXTURE

(71) Applicant: DMF, Inc., Carson, CA (US)

(72) Inventor: Michael D. Danesh, Carson, CA (US)

(73) Assignee: DMF, Inc., Carson, CA (US)

( * ) Notice: Subject to any disclaimer, the term of this patent is extended or adjusted under 35 U.S.C. 154(b) by 55 days.

(21) Appl. No.: 16/779,824

(22) Filed: Feb. 3, 2020

(65) Prior Publication Data

US 2021/0033268 A1 Feb. 4, 2021

Related U.S. Application Data

(63) Continuation of application No. 15/132,875, filed on Apr. 19, 2016, now Pat. No. 10,563,850.

(60) Provisional application No. 62/151,308, filed on Apr. 22, 2015.

(51) Int. Cl.

| | |
|---|---|
| ***F21V 21/14*** | (2006.01) |
| ***F21S 8/02*** | (2006.01) |
| *F21V 21/04* | (2006.01) |
| *F21V 23/06* | (2006.01) |
| *F21V 23/00* | (2015.01) |
| *F21Y 115/15* | (2016.01) |
| *F21Y 115/10* | (2016.01) |

(52) U.S. Cl.

CPC ..... *F21V 21/14* (2013.01); *F21S 8/024* (2013.01); *F21S 8/026* (2013.01); *F21V 21/04* (2013.01); *F21V 23/009* (2013.01); *F21V 23/06* (2013.01); *F21Y 2115/10* (2016.08); *F21Y 2115/15* (2016.08)

(58) Field of Classification Search

CPC ..... F21V 21/14; F21S 8/024; F21S 8/026

See application file for complete search history.

(56) References Cited

U.S. PATENT DOCUMENTS

| | | | |
|---|---|---|---|
| 1,133,535 | A | 3/1915 | Cain et al. |
| 1,471,340 | A | 10/1923 | Knight |
| 1,856,356 | A | 5/1932 | Owen |
| 2,038,784 | A | 4/1936 | Ghadiali |
| 2,179,161 | A | 11/1939 | Rambusch |

(Continued)

FOREIGN PATENT DOCUMENTS

| | | | |
|---|---|---|---|
| CA | 2243934 | C | 6/2002 |
| CA | 2502637 | A1 | 9/2005 |

(Continued)

OTHER PUBLICATIONS

"Advanced LED Solutions," Imtra Marine Lighting. Jun. 17, 2011. 39 pages.

(Continued)

*Primary Examiner* — Bryon T Gyllstrom
*Assistant Examiner* — Christopher E Dunay
(74) *Attorney, Agent, or Firm* — Smith Baluch LLP

(57) ABSTRACT

The recessed lighting fixture includes a light source module and a driver housed within a unified casting, and within a shared outer casing. The outer casing may be coupled to a hangar holder that is movably coupled to a corresponding hangar bar. The outer casing, including the light source module and driver installed therein, may move both 1) in the length direction of the hangar bar and 2) perpendicular to the length direction of the hangar bar. The recessed lighting fixture may have less bulk and size than traditional recessed lighting fixtures. Other embodiments are also described and claimed.

40 Claims, 8 Drawing Sheets

(56) References Cited

U.S. PATENT DOCUMENTS 2,197,737 A 4/1940 Appleton
2,352,913 A 7/1944 Morrill
2,528,989 A 11/1950 Ammells
2,597,595 A 5/1952 Ordas
2,642,246 A 6/1953 Larry
2,670,919 A 3/1954 Vincent
2,697,535 A 12/1954 Olson
2,758,810 A 8/1956 Good
D180,844 S 8/1957 Poliakoff
2,802,933 A 8/1957 Harry
2,998,512 A 8/1961 Duchene et al.
3,023,920 A 3/1962 Cook et al.
3,057,993 A 10/1962 Gellert
3,104,087 A 9/1963 Joseph et al.
3,214,126 A 10/1965 Roos
3,422,261 A 1/1969 McGinty
3,460,299 A 8/1969 Wilson
3,650,046 A 3/1972 Skinner
3,675,807 A 7/1972 Lund et al.
3,700,885 A 10/1972 Bobrick
3,711,053 A 1/1973 Drake
D227,989 S 7/1973 Geisel
3,773,968 A 11/1973 Copp
3,812,342 A 5/1974 Mcnamara
3,836,766 A 9/1974 Auerbach
3,874,035 A 4/1975 Schuplin
3,913,773 A 10/1975 Copp et al.
D245,905 S 9/1977 Taylor
4,088,827 A 5/1978 Kohaut
4,176,758 A 12/1979 Glick
4,280,169 A 7/1981 Allen
4,399,497 A 8/1983 Druffel
4,450,512 A 5/1984 Kristofek
4,460,948 A 7/1984 Malola
4,520,435 A 5/1985 Baldwin
4,539,629 A 9/1985 Poppenheimer
4,601,145 A 7/1986 Wilcox
4,667,840 A 5/1987 Lindsey
4,723,747 A 2/1988 Karp et al.
4,729,080 A 3/1988 Fremont et al.
4,754,377 A 6/1988 Wenman
4,770,311 A 9/1988 Wang
4,880,128 A 11/1989 Jorgensen
4,910,651 A 3/1990 Montanez
4,919,292 A 4/1990 Hsu
4,929,187 A 5/1990 Hudson et al.
4,930,054 A 5/1990 Krebs
5,044,582 A 9/1991 Walters
D326,537 S 5/1992 Gattari
5,216,203 A 6/1993 Gower
5,222,800 A 6/1993 Chan et al.
5,239,132 A 8/1993 Bartow
5,250,269 A 10/1993 Langer et al.
5,266,050 A 11/1993 O'Neil et al.
5,303,894 A 4/1994 Deschamps et al.
5,382,752 A 1/1995 Reyhan et al.
5,420,376 A 5/1995 Rajecki et al.
5,465,199 A 11/1995 Bray et al.
5,505,419 A 4/1996 Gabrius
5,544,870 A 8/1996 Kelly et al.
5,562,343 A 10/1996 Chan et al.
5,571,993 A 11/1996 Jones et al.
5,580,158 A 12/1996 Aubrey et al.
5,588,737 A 12/1996 Kusmer
5,603,424 A 2/1997 Bordwell et al.
5,609,408 A 3/1997 Targetti
5,613,338 A 3/1997 Esposito
D381,111 S 7/1997 Lecluze
5,662,413 A 9/1997 Akiyama et al.
D386,277 S 11/1997 Lecluze
5,690,423 A 11/1997 Hentz et al.
D387,466 S 12/1997 Lecluze
5,738,436 A 4/1998 Cummings et al.
5,836,678 A 11/1998 Wright et al.
5,942,726 A 8/1999 Reiker
5,944,412 A 8/1999 Janos et al.
5,957,573 A 9/1999 Wedekind et al.
6,082,878 A 7/2000 Doubek et al.
6,095,669 A 8/2000 Cho
6,098,945 A 8/2000 Korcz
6,105,334 A 8/2000 Monson et al.
6,161,910 A 12/2000 Reisenauer et al.
6,170,685 B1 1/2001 Currier
6,174,076 B1 1/2001 Petrakis et al.
6,176,599 B1 1/2001 Farzen
6,267,491 B1 7/2001 Parrigin
6,332,597 B1 12/2001 Korcz et al.
6,350,043 B1 2/2002 Gloisten
6,350,046 B1 2/2002 Lau
6,364,511 B1 4/2002 Cohen
6,375,338 B1 4/2002 Cummings et al.
6,402,112 B1 6/2002 Thomas et al.
D461,455 S 8/2002 Forbes
6,461,016 B1 10/2002 Jamison et al.
6,474,846 B1 11/2002 Kelmelis et al.
6,491,413 B1 12/2002 Benesohn
D468,697 S 1/2003 Straub, Jr.
D470,970 S 2/2003 Huang
6,515,313 B1 2/2003 Ibbetson et al.
6,521,833 B1 2/2003 DeFreitas
D471,657 S 3/2003 Huang
6,583,573 B2 6/2003 Bierman
6,585,389 B2 7/2003 Bonazzi
6,600,175 B1 7/2003 Baretz et al.
D478,872 S 8/2003 Heggem
6,632,006 B1 10/2003 Rippel et al.
6,657,236 B1 12/2003 Thibeault et al.
6,666,419 B1 12/2003 Vrame
D488,583 S 4/2004 Benghozi
6,719,438 B2 4/2004 Sevack et al.
6,758,578 B1 7/2004 Chou
6,777,615 B1 8/2004 Gretz
6,779,908 B1 8/2004 Ng
6,827,229 B2 12/2004 Dinh et al.
6,838,618 B2 1/2005 Newbold et al.
6,906,352 B2 6/2005 Edmond et al.
D509,314 S 9/2005 Rashidi
6,948,829 B2 9/2005 Verdes et al.
6,958,497 B2 10/2005 Emerson et al.
6,964,501 B2 11/2005 Ryan
6,967,284 B1 11/2005 Gretz
D516,235 S 2/2006 Rashidi
7,025,477 B2 4/2006 Blessing
7,064,269 B2 6/2006 Smith
D528,673 S 9/2006 Maxik et al.
7,102,172 B2 9/2006 Lynch
D531,740 S 11/2006 Maxik
D532,532 S 11/2006 Maxik
7,148,420 B1 12/2006 Johnson et al.
7,148,632 B2 12/2006 Berman et al.
7,154,040 B1 12/2006 Tompkins
7,170,015 B1 1/2007 Roesch et al.
D536,349 S 2/2007 Humber et al.
D537,039 S 2/2007 Pincek
D539,229 S 3/2007 Murphey
7,186,008 B2 3/2007 Patti
7,190,126 B1 3/2007 Paton
7,211,833 B2 5/2007 Slater, Jr. et al.
7,213,940 B1 5/2007 Van De Ven et al.
7,234,674 B2 6/2007 Rippel et al.
D547,889 S 7/2007 Huang
D552,969 S 10/2007 Bobrowski et al.
D553,267 S 10/2007 Yuen
D555,106 S 11/2007 Pape et al.
D556,144 S 11/2007 Dinh
7,297,870 B1 11/2007 Sartini
7,312,474 B2 12/2007 Emerson et al.
7,320,536 B2 1/2008 Petrakis et al.
D561,372 S 2/2008 Yan
D561,373 S 2/2008 Yan
7,335,920 B2 2/2008 Denbaars et al.
D563,896 S 3/2008 Greenslate
7,347,580 B2 3/2008 Blackman et al.
D570,012 S 5/2008 Huang

(56) References Cited

U.S. PATENT DOCUMENTS 7,374,308 B2 5/2008 Sevack et al.
D570,504 S 6/2008 Maxik et al.
D570,505 S 6/2008 Maxik et al.
7,399,104 B2 7/2008 Rappaport
7,429,025 B1 9/2008 Gretz
D578,677 S 10/2008 Huang
7,431,482 B1 10/2008 Morgan et al.
7,432,440 B2 10/2008 Hull et al.
7,442,883 B2 10/2008 Jolly et al.
7,446,345 B2 11/2008 Emerson et al.
7,470,048 B2 12/2008 Wu
7,473,005 B2 1/2009 O'Brien
7,488,097 B2 2/2009 Reisenauer et al.
7,494,258 B2 2/2009 McNaught
7,503,145 B2 3/2009 Newbold et al.
7,524,089 B2 4/2009 Park
D591,894 S 5/2009 Flank
7,534,989 B2 5/2009 Suehara et al.
D596,154 S 7/2009 Rivkin
7,566,154 B2 7/2009 Gloisten et al.
D599,040 S 8/2009 Alexander et al.
D600,836 S 9/2009 Hanley et al.
7,588,359 B2 9/2009 Coushaine et al.
7,592,583 B2 9/2009 Page et al.
D606,696 S 12/2009 Chen et al.
7,625,105 B1 12/2009 Johnson
7,628,513 B2 12/2009 Chiu
7,651,238 B2 1/2010 O'Brien
7,654,705 B2 2/2010 Czech et al.
D611,650 S 3/2010 Broekhoff
7,670,021 B2 3/2010 Chou
7,673,841 B2 3/2010 Wronski
7,677,766 B2 3/2010 Boyer
7,692,182 B2 4/2010 Bergmann et al.
7,704,763 B2 4/2010 Fujii et al.
D616,118 S 5/2010 Thomas et al.
7,722,208 B1 5/2010 Dupre et al.
7,722,227 B2 5/2010 Zhang et al.
7,735,795 B2 6/2010 Wronski
7,735,798 B2 6/2010 Kojima
7,748,887 B2 7/2010 Zampini, II et al.
7,766,518 B2 8/2010 Piepgras et al.
7,769,192 B2 8/2010 Takagi et al.
7,771,082 B2 8/2010 Peng
7,771,094 B2 8/2010 Goode
7,784,754 B2 8/2010 Nevers et al.
D624,691 S 9/2010 Zhang et al.
D624,692 S 9/2010 Mackin et al.
D625,847 S 10/2010 Maglica
D625,876 S 10/2010 Chen et al.
D627,507 S 11/2010 Lai et al.
D627,727 S 11/2010 Alexander et al.
7,828,465 B2 11/2010 Roberge et al.
D629,366 S 12/2010 Ericson et al.
7,845,393 B2 12/2010 Kao et al.
7,857,275 B2 12/2010 de la Borbolla
7,871,184 B2 1/2011 Peng
7,874,539 B2 1/2011 Wright et al.
7,874,703 B2 1/2011 Shastry et al.
7,874,709 B1 1/2011 Beadle
D633,224 S 2/2011 Lee
7,909,487 B1 3/2011 Venetucci et al.
D636,903 S 4/2011 Torenbeek
D637,339 S 5/2011 Hasan et al.
D637,340 S 5/2011 Hasan et al.
7,950,832 B2 5/2011 Tanaka et al.
D639,499 S 6/2011 Choi et al.
D640,819 S 6/2011 Pan
7,956,546 B2 6/2011 Hasnain
7,959,332 B2 6/2011 Tickner et al.
7,967,480 B2 6/2011 Pickard et al.
D642,317 S 7/2011 Rashidi
7,972,035 B2 7/2011 Boyer
7,972,043 B2 7/2011 Schutte
D642,536 S 8/2011 Robinson
D643,970 S 8/2011 Kim et al.
8,002,425 B2 8/2011 Russo et al.
D646,011 S 9/2011 Rashidi
8,013,243 B2 9/2011 Korcz et al.
8,038,113 B2 10/2011 Fryzek et al.
D648,476 S 11/2011 Choi et al.
D648,477 S 11/2011 Kim et al.
D650,115 S 12/2011 Kim et al.
8,070,328 B1 12/2011 Knoble et al.
8,096,670 B2 1/2012 Trott
D654,205 S 2/2012 Rashidi
D656,262 S 3/2012 Yoshinobu et al.
D656,263 S 3/2012 Ogawa et al.
8,142,057 B2 3/2012 Roos et al.
8,152,334 B2 4/2012 Krogman
D658,788 S 5/2012 Dudik et al.
D658,802 S 5/2012 Chen
D659,862 S 5/2012 Tsai
D659,879 S 5/2012 Rashidi
D660,814 S 5/2012 Wilson
8,182,116 B2 5/2012 Zhang et al.
8,201,968 B2 6/2012 Maxik et al.
D663,058 S 7/2012 Pan
D663,466 S 7/2012 Rashidi
D664,274 S 7/2012 de Visser et al.
D664,705 S 7/2012 Kong et al.
8,215,805 B2 7/2012 Cogliano et al.
8,220,970 B1 7/2012 Khazi et al.
8,226,270 B2 7/2012 Yamamoto et al.
8,235,549 B2 8/2012 Gingrich, III et al.
8,240,630 B2 8/2012 Wronski
D667,155 S 9/2012 Rashidi
8,262,255 B1 9/2012 Rashidi
D668,372 S 10/2012 Renshaw et al.
D668,809 S 10/2012 Rashidi
D669,198 S 10/2012 Qiu
D669,199 S 10/2012 Chuang
D669,620 S 10/2012 Rashidi
8,277,090 B2 10/2012 Fryzek et al.
D671,668 S 11/2012 Rowlette, Jr. et al.
8,308,322 B2 11/2012 Santiago et al.
D672,899 S 12/2012 Ven et al.
D673,869 S 1/2013 Yu
D676,263 S 2/2013 Birke
D676,814 S 2/2013 Paul
8,376,593 B2 2/2013 Bazydola et al.
D677,417 S 3/2013 Rashidi
D677,634 S 3/2013 Korcz et al.
D679,044 S 3/2013 Jeswani et al.
D679,047 S 3/2013 Tickner et al.
8,403,533 B1 3/2013 Paulsel
8,403,541 B1 3/2013 Rashidi
8,405,947 B1 3/2013 Green et al.
D681,259 S 4/2013 Kong
8,408,759 B1 4/2013 Rashidi
D682,459 S 5/2013 Gordin et al.
D683,063 S 5/2013 Lopez et al.
D683,890 S 6/2013 Lopez et al.
D684,269 S 6/2013 Wang et al.
D684,287 S 6/2013 Rashidi
D684,719 S 6/2013 Rashidi
D685,118 S 6/2013 Rashidi
D685,120 S 6/2013 Rashidi
8,454,204 B1 6/2013 Chang et al.
D685,507 S 7/2013 Sun
D687,586 S 8/2013 Rashidi
D687,587 S 8/2013 Rashidi
D687,588 S 8/2013 Rashidi
D687,980 S 8/2013 Gravely et al.
D688,405 S 8/2013 Kim et al.
8,506,127 B2 8/2013 Russello et al.
8,506,134 B2 8/2013 Wilson et al.
D690,049 S 9/2013 Rashidi
D690,864 S 10/2013 Rashidi
D690,865 S 10/2013 Rashidi
D690,866 S 10/2013 Rashidi
D691,314 S 10/2013 Rashidi
D691,315 S 10/2013 Samson
D691,763 S 10/2013 Hand et al.

(56) References Cited

U.S. PATENT DOCUMENTS 8,550,669 B2 10/2013 Macwan et al.
D693,043 S 11/2013 Schmalfuss et al.
D693,517 S 11/2013 Davis
D694,456 S 11/2013 Rowlette, Jr. et al.
8,573,816 B2 11/2013 Negley et al.
D695,441 S 12/2013 Lui et al.
D695,941 S 12/2013 Rashidi
D696,446 S 12/2013 Huh
D696,447 S 12/2013 Huh
D696,448 S 12/2013 Huh
8,602,601 B2 12/2013 Khazi et al.
D698,067 S 1/2014 Rashidi
D698,068 S 1/2014 Rashidi
8,622,361 B2 1/2014 Wronski
8,632,040 B2 1/2014 Mass et al.
D698,985 S 2/2014 Lopez et al.
D699,384 S 2/2014 Rashidi
D699,687 S 2/2014 Baldwin et al.
D700,387 S 2/2014 Snell
8,641,243 B1 2/2014 Rashidi
8,659,034 B2 2/2014 Baretz et al.
D700,991 S 3/2014 Johnson et al.
D701,175 S 3/2014 Baldwin et al.
D701,466 S 3/2014 Clifford et al.
8,672,518 B2 3/2014 Boomgaarden et al.
D702,867 S 4/2014 Kim et al.
D703,843 S 4/2014 Cheng
8,684,569 B2 4/2014 Pickard et al.
D705,472 S 5/2014 Huh
D705,481 S 5/2014 Zhang et al.
8,727,582 B2 5/2014 Brown et al.
D708,381 S 7/2014 Rashidi
8,777,449 B2 7/2014 Ven et al.
D710,529 S 8/2014 Lopez et al.
8,801,217 B2 8/2014 Oehle et al.
8,820,985 B1 9/2014 Tam et al.
8,833,013 B2 9/2014 Harman
8,845,144 B1 9/2014 Davies et al.
D714,989 S 10/2014 Rowlette, Jr. et al.
8,870,426 B2 10/2014 Biebl et al.
8,890,414 B2 11/2014 Rowlette, Jr. et al.
D721,845 S 1/2015 Lui et al.
8,926,133 B2 1/2015 Booth
8,939,418 B2 1/2015 Green et al.
D722,296 S 2/2015 Taylor
D722,977 S 2/2015 Hagarty
D722,978 S 2/2015 Hagarty
8,950,898 B2 2/2015 Catalano
D723,781 S 3/2015 Miner
D723,783 S 3/2015 Miner
D725,359 S 3/2015 Miner
8,967,575 B1 3/2015 Gretz
D726,363 S 4/2015 Danesh
D726,949 S 4/2015 Redfern
9,004,435 B2 4/2015 Wronski
9,039,254 B2 5/2015 Danesh
D731,689 S 6/2015 Bernard et al.
9,062,866 B1 6/2015 Christ et al.
9,065,264 B2 6/2015 Cooper et al.
9,068,719 B2 6/2015 Van De Ven et al.
9,068,722 B2 6/2015 Wronski et al.
D734,525 S 7/2015 Gordin et al.
D735,012 S 7/2015 Cowie
D735,142 S 7/2015 Hagarty
9,078,299 B2 7/2015 Ashdown
D739,355 S 9/2015 D'Aubeterre
D739,590 S 9/2015 Redfern
9,140,441 B2 9/2015 Goelz et al.
D741,538 S 10/2015 Ghasabi
9,151,457 B2 10/2015 Pickard et al.
9,151,477 B2 10/2015 Pickard et al.
D742,325 S 11/2015 Leung
D743,079 S 11/2015 Adair
D744,723 S 12/2015 Yoo
9,217,560 B2 12/2015 Harbers et al.
9,222,661 B2 12/2015 Kim et al.
9,239,131 B1 1/2016 Wronski et al.
D750,317 S 2/2016 Lui et al.
9,285,103 B2 3/2016 Van De Ven et al.
9,291,319 B2 3/2016 Kathawate et al.
9,301,362 B2 3/2016 Dohn et al.
D754,078 S 4/2016 Baldwin et al.
D754,079 S 4/2016 Baldwin et al.
D754,605 S 4/2016 McMillan
9,303,812 B2 4/2016 Green et al.
9,310,038 B2 4/2016 Athalye
9,322,543 B2 4/2016 Hussell et al.
9,347,655 B2 5/2016 Boomgaarden et al.
9,366,418 B2 6/2016 Gifford
9,371,966 B2 6/2016 Rowlette, Jr. et al.
D762,181 S 7/2016 Lin
9,395,051 B2 7/2016 Hussell et al.
D762,906 S 8/2016 Jeswani et al.
D764,079 S 8/2016 Wu
9,417,506 B1 8/2016 Tirosh
D766,185 S 9/2016 Hagarty
D767,199 S 9/2016 Wronski et al.
9,447,917 B1 9/2016 Wronski et al.
9,447,953 B2 9/2016 Lawlor
D768,325 S 10/2016 Xu
D768,326 S 10/2016 Guzzini
D769,501 S 10/2016 Jeswani et al.
D770,065 S 10/2016 Tittle
D770,076 S 10/2016 Li et al.
9,476,552 B2 10/2016 Myers et al.
D774,676 S 12/2016 Ng
D776,324 S 1/2017 Gierl et al.
D777,967 S 1/2017 Redfern
9,534,751 B2 1/2017 Maglica et al.
D778,241 S 2/2017 Holbrook et al.
D778,484 S 2/2017 Guzzini
D779,100 S 2/2017 Redfern
9,581,302 B2 2/2017 Danesh
9,599,315 B1 3/2017 Harpenau et al.
9,605,842 B1 3/2017 Davis
9,605,910 B2 3/2017 Swedberg et al.
D785,228 S 4/2017 Guzzini
D786,472 S 5/2017 Redfern
D786,473 S 5/2017 Dean
D786,474 S 5/2017 Fujisawa
D788,330 S 5/2017 Johnson et al.
D790,102 S 6/2017 Guzzini
9,673,597 B2 6/2017 Lee
9,689,541 B2 6/2017 Wronski
D791,709 S 7/2017 Holton
D791,711 S 7/2017 Holton
D791,712 S 7/2017 Holton
9,696,021 B2 7/2017 Wronski
9,702,516 B1 7/2017 Vasquez et al.
D795,820 S 8/2017 Wengreen
9,732,904 B1 8/2017 Wronski
9,732,947 B1 8/2017 Christ et al.
9,739,464 B2 8/2017 Wronski
D799,105 S 10/2017 Eder et al.
D800,957 S 10/2017 Eder et al.
9,791,111 B1 10/2017 Huang et al.
9,797,562 B2 10/2017 Dabiet et al.
9,803,839 B2 10/2017 Visser et al.
D805,660 S 12/2017 Creasman et al.
D809,176 S 1/2018 Partington
9,860,961 B2 1/2018 Chemel et al.
9,863,619 B2 1/2018 Mak
D809,465 S 2/2018 Keirstead
9,903,569 B2 2/2018 O'Brien et al.
9,964,266 B2 5/2018 Danesh
D820,494 S 6/2018 Cohen
D821,615 S 6/2018 Trice
D821,627 S 6/2018 Ko
9,995,441 B2 6/2018 Power et al.
D822,505 S 7/2018 Gibson et al.
D824,494 S 7/2018 Martins et al.
D825,829 S 8/2018 Guo
10,041,638 B2 8/2018 Vasquez et al.
10,054,274 B2 8/2018 Athalye et al.

(56) References Cited

U.S. PATENT DOCUMENTS

D827,903 S 9/2018 Wu
D832,218 S 10/2018 Wronski et al.
D833,977 S 11/2018 Danesh et al.
10,125,959 B2 11/2018 Cohen
10,139,059 B2 11/2018 Danesh
D836,976 S 1/2019 Reese et al.
D847,414 S 4/2019 Danesh et al.
D847,415 S 4/2019 Danesh et al.
10,247,390 B1 4/2019 Kopitzke et al.
D848,375 S 5/2019 Danesh et al.
10,281,131 B2 5/2019 Cohen
10,295,163 B1 5/2019 Cohen
D850,695 S 6/2019 Dabiet et al.
D851,046 S 6/2019 Peng et al.
10,408,395 B2 9/2019 Danesh
10,408,396 B2 9/2019 Wronski et al.
10,408,436 B2 9/2019 Wronski et al.
D863,661 S 10/2019 Tian et al.
D864,877 S 10/2019 Danesh
D867,653 S 11/2019 Gorman
10,488,000 B2 11/2019 Danesh et al.
10,551,044 B2 2/2020 Peng et al.
10,563,850 B2 2/2020 Danesh
10,591,120 B2 3/2020 Bailey et al.
D880,733 S 4/2020 Lo et al.
D883,562 S 5/2020 Hu
D885,648 S 5/2020 Zeng
D885,649 S 5/2020 McLaughlin, III et al.
10,663,127 B2 5/2020 Danesh et al.
10,663,153 B2 5/2020 Nikooyan et al.
D888,313 S 6/2020 Xie et al.
10,683,994 B2 6/2020 Wronski et al.
10,684,003 B2 6/2020 Wronski et al.
D890,410 S 7/2020 Stanford et al.
10,753,558 B2 8/2020 Danesh
10,816,148 B2 10/2020 Danesh
D901,398 S 11/2020 Danesh et al.
D901,745 S 11/2020 Yang
D902,871 S 11/2020 Danesh et al.
D903,605 S 12/2020 Danesh et al.
2002/0172047 A1 11/2002 Ashley
2003/0006353 A1 1/2003 Dinh et al.
2003/0016532 A1 1/2003 Reed
2003/0021104 A1 1/2003 Tsao
2003/0161153 A1 8/2003 Patti
2004/0001337 A1 1/2004 Defouw et al.
2004/0120141 A1 6/2004 Beadle
2004/0156199 A1 8/2004 Rivas et al.
2005/0078474 A1 4/2005 Whitfield
2005/0225966 A1 10/2005 Hartmann et al.
2005/0227536 A1 10/2005 Gamache et al.
2005/0231962 A1 10/2005 Koba et al.
2005/0237746 A1 10/2005 Yiu
2006/0005988 A1 1/2006 Jorgensen
2006/0158873 A1 7/2006 Newbold et al.
2006/0198126 A1 9/2006 Jones
2006/0215408 A1 9/2006 Lee
2006/0221620 A1 10/2006 Thomas
2006/0237601 A1 10/2006 Rinderer
2006/0243877 A1 11/2006 Rippel
2006/0250788 A1 11/2006 Hodge et al.
2006/0262536 A1 11/2006 Nevers
2006/0262545 A1 11/2006 Piepgras et al.
2007/0012847 A1 1/2007 Tai
2007/0035951 A1 2/2007 Tseng
2007/0121328 A1 5/2007 Mondloch et al.
2007/0131827 A1 6/2007 Nevers et al.
2007/0185675 A1 8/2007 Papamichael et al.
2007/0200039 A1 8/2007 Petak
2007/0206374 A1 9/2007 Petrakis et al.
2008/0002414 A1 1/2008 Miletich et al.
2008/0112168 A1 5/2008 Pickard et al.
2008/0112170 A1 5/2008 Trott
2008/0112171 A1 5/2008 Patti et al.
2008/0130308 A1 6/2008 Behr et al.
2008/0137347 A1 6/2008 Trott et al.
2008/0165545 A1 7/2008 O'Brien
2008/0170404 A1 7/2008 Steer et al.
2008/0224008 A1 9/2008 Dal Ponte et al.
2008/0232116 A1 9/2008 Kim
2008/0247181 A1 10/2008 Dixon
2008/0285271 A1 11/2008 Roberge et al.
2009/0003009 A1 1/2009 Tessnow et al.
2009/0034261 A1 2/2009 Grove
2009/0080189 A1 3/2009 Wegner
2009/0086484 A1 4/2009 Johnson
2009/0097262 A1 4/2009 Zhang et al.
2009/0135613 A1 5/2009 Peng
2009/0141500 A1 6/2009 Peng
2009/0141506 A1 6/2009 Lan et al.
2009/0141508 A1 6/2009 Peng
2009/0147517 A1 6/2009 Li
2009/0161356 A1 6/2009 Negley et al.
2009/0237924 A1 9/2009 Ladewig
2009/0280695 A1 11/2009 Sekela et al.
2009/0283292 A1 11/2009 Lehr
2009/0290343 A1 11/2009 Brown et al.
2010/0014282 A1 1/2010 Danesh
2010/0033095 A1 2/2010 Sadwick
2010/0061108 A1 3/2010 Zhang et al.
2010/0110690 A1 5/2010 Hsu et al.
2010/0110698 A1 5/2010 Harwood et al.
2010/0110699 A1 5/2010 Chou
2010/0148673 A1 6/2010 Stewart et al.
2010/0149822 A1 6/2010 Cogliano et al.
2010/0165643 A1 7/2010 Russo et al.
2010/0244709 A1 9/2010 Steiner et al.
2010/0246172 A1 9/2010 Liu
2010/0259919 A1 10/2010 Khazi et al.
2010/0270903 A1 10/2010 Jao et al.
2010/0277905 A1 11/2010 Janik et al.
2010/0284185 A1 11/2010 Ngai
2010/0302778 A1 12/2010 Dabiet et al.
2011/0043040 A1 2/2011 Porter et al.
2011/0063831 A1 3/2011 Cook
2011/0068687 A1 3/2011 Takahasi et al.
2011/0069499 A1 3/2011 Trott et al.
2011/0080750 A1 4/2011 Jones et al.
2011/0116276 A1 5/2011 Okamura et al.
2011/0121756 A1 5/2011 Thomas et al.
2011/0134634 A1 6/2011 Gingrich, III et al.
2011/0134651 A1 6/2011 Berman
2011/0140633 A1 6/2011 Archenhold
2011/0170294 A1 7/2011 Mier-Langner et al.
2011/0194299 A1 8/2011 Crooks et al.
2011/0216534 A1 9/2011 Tickner et al.
2011/0226919 A1 9/2011 Fryzek et al.
2011/0255292 A1 10/2011 Shen
2011/0267828 A1 11/2011 Bazydola et al.
2011/0285314 A1 11/2011 Carney et al.
2012/0020104 A1 1/2012 Biebl et al.
2012/0074852 A1 3/2012 Delnoij
2012/0106176 A1 5/2012 Lopez et al.
2012/0113642 A1 5/2012 Catalano
2012/0140442 A1 6/2012 Woo et al.
2012/0140465 A1 6/2012 Rowlette, Jr. et al.
2012/0162994 A1 6/2012 Wasniewski et al.
2012/0182744 A1 7/2012 Santiago et al.
2012/0188762 A1 7/2012 Joung et al.
2012/0243237 A1 9/2012 Toda et al.
2012/0266449 A1 10/2012 Krupa
2012/0268688 A1 10/2012 Sato et al.
2012/0287625 A1 11/2012 Macwan et al.
2012/0305868 A1 12/2012 Callahan et al.
2012/0314429 A1 12/2012 Plunk
2013/0009552 A1 1/2013 Page
2013/0010476 A1 1/2013 Pickard et al.
2013/0016864 A1 1/2013 Ivey et al.
2013/0033872 A1 2/2013 Randolph et al.
2013/0051012 A1 2/2013 Oehle et al.
2013/0077307 A1 3/2013 Yamamoto
2013/0083529 A1 4/2013 Gifford
2013/0141913 A1 6/2013 Sachsenweger
2013/0155681 A1 6/2013 Nall et al.

(56) References Cited

U.S. PATENT DOCUMENTS

| | | | |
|---|---|---|---|
| 2013/0163254 | A1 | 6/2013 | Chang et al. |
| 2013/0170232 | A1 | 7/2013 | Park et al. |
| 2013/0170233 | A1 | 7/2013 | Nezu et al. |
| 2013/0227908 | A1 | 9/2013 | Gulbrandsen et al. |
| 2013/0258677 | A1 | 10/2013 | Fryzek et al. |
| 2013/0265750 | A1 | 10/2013 | Pickard et al. |
| 2013/0271989 | A1 | 10/2013 | Hussell et al. |
| 2013/0294084 | A1 | 11/2013 | Kathawate et al. |
| 2013/0301252 | A1 | 11/2013 | Hussell et al. |
| 2013/0322062 | A1 | 12/2013 | Danesh |
| 2013/0322084 | A1 | 12/2013 | Ebisawa |
| 2013/0335980 | A1 | 12/2013 | Nakasuji et al. |
| 2014/0029262 | A1 | 1/2014 | Maxik et al. |
| 2014/0036497 | A1 | 2/2014 | Hussell et al. |
| 2014/0049957 | A1 | 2/2014 | Goelz et al. |
| 2014/0063776 | A1 | 3/2014 | Clark et al. |
| 2014/0071679 | A1 | 3/2014 | Booth |
| 2014/0071687 | A1 | 3/2014 | Tickner et al. |
| 2014/0140490 | A1 | 5/2014 | Roberts et al. |
| 2014/0063818 | A1 | 6/2014 | Randolph et al. |
| 2014/0233246 | A1 | 8/2014 | Lafreniere et al. |
| 2014/0254177 | A1 | 9/2014 | Danesh |
| 2014/0268836 | A1 | 9/2014 | Thompson |
| 2014/0268869 | A1 | 9/2014 | Blessitt et al. |
| 2014/0299730 | A1 | 10/2014 | Green et al. |
| 2014/0313775 | A1 | 10/2014 | Myers et al. |
| 2014/0321122 | A1 | 10/2014 | Domagala et al. |
| 2014/0347848 | A1 | 11/2014 | Pisavadia et al. |
| 2015/0009676 | A1 | 1/2015 | Danesh |
| 2015/0029732 | A1 | 1/2015 | Hatch |
| 2015/0078008 | A1 | 3/2015 | He |
| 2015/0085500 | A1 | 3/2015 | Cooper et al. |
| 2015/0138779 | A1 | 5/2015 | Livesay et al. |
| 2015/0176823 | A1 | 6/2015 | Leshniak et al. |
| 2015/0184837 | A1 | 7/2015 | Zhang et al. |
| 2015/0198324 | A1 | 7/2015 | O'Brien et al. |
| 2015/0204491 | A1 | 7/2015 | Yuan et al. |
| 2015/0219317 | A1 | 8/2015 | Gatof et al. |
| 2015/0233556 | A1 | 8/2015 | Danesh |
| 2015/0241039 | A1 | 8/2015 | Fryzek |
| 2015/0263497 | A1 | 9/2015 | Korcz et al. |
| 2015/0276185 | A1 | 10/2015 | Bailey et al. |
| 2015/0308662 | A1 | 10/2015 | Vice et al. |
| 2015/0345761 | A1 | 12/2015 | Lawlor |
| 2015/0362159 | A1 | 12/2015 | Ludyjan |
| 2016/0084488 | A1 | 3/2016 | Wu et al. |
| 2016/0209007 | A1 | 7/2016 | Belmonte et al. |
| 2016/0238225 | A1 | 8/2016 | Doust |
| 2016/0308342 | A1 | 10/2016 | Witherbee et al. |
| 2016/0312987 | A1 | 10/2016 | Danesh |
| 2016/0348860 | A1 | 12/2016 | Danesh |
| 2016/0348861 | A1 | 12/2016 | Bailey et al. |
| 2016/0366738 | A1 | 12/2016 | Boulanger et al. |
| 2017/0003007 | A1 | 1/2017 | Wronski |
| 2017/0045213 | A1 | 2/2017 | Williams et al. |
| 2017/0059135 | A1 | 3/2017 | Jones |
| 2017/0138576 | A1 | 5/2017 | Peng et al. |
| 2017/0138581 | A1 | 5/2017 | Doust |
| 2017/0167672 | A1 | 6/2017 | Stauner et al. |
| 2017/0167699 | A1 | 6/2017 | Schubert et al. |
| 2017/0198896 | A1 | 7/2017 | May |
| 2017/0284616 | A1 | 10/2017 | Coakley et al. |
| 2017/0307188 | A1 | 10/2017 | Oudina et al. |
| 2018/0112857 | A1 | 4/2018 | Wronski et al. |
| 2018/0142871 | A1 | 5/2018 | Morales |
| 2018/0216809 | A1 | 8/2018 | Cohen |
| 2018/0224095 | A1 | 8/2018 | Cohen |
| 2018/0231197 | A1 | 8/2018 | Danesh |
| 2018/0283677 | A1 | 10/2018 | Cohen |
| 2018/0372284 | A1 | 12/2018 | Danesh et al. |
| 2019/0032874 | A1 | 1/2019 | Bonnetto et al. |
| 2019/0041050 | A1 | 2/2019 | Cairns et al. |
| 2019/0049080 | A1 | 2/2019 | Danesh |
| 2019/0063701 | A1 | 2/2019 | Lotfi et al. |
| 2019/0093836 | A1 | 3/2019 | Danesh |
| 2020/0182420 | A1 | 6/2020 | Cohen et al. |
| 2020/0291652 | A1 | 9/2020 | Shen |
| 2020/0393118 | A1 | 12/2020 | Danesh et al. |
| 2021/0010647 | A1 | 1/2021 | Danesh et al. |

FOREIGN PATENT DOCUMENTS

| | | | |
|---|---|---|---|
| CA | 2691480 | C | 4/2012 |
| CA | 2734369 | A1 | 10/2013 |
| CA | 2561459 | A1 | 11/2013 |
| CA | 2815067 | | 11/2013 |
| CA | 2848289 | A1 | 10/2014 |
| CA | 2998173 | | 7/2018 |
| CN | 2182475 | Y | 11/1994 |
| CN | 201059503 | Y | 5/2008 |
| CN | 201259125 | Y | 6/2009 |
| CN | 101608781 | A | 12/2009 |
| CN | 201636626 | U | 11/2010 |
| CN | 102062373 | A | 5/2011 |
| CN | 202014067 | U | 10/2011 |
| CN | 202392473 | U | 8/2012 |
| CN | 202733693 | U | 2/2013 |
| CN | 103307518 | A | 9/2013 |
| CN | 103322476 | A | 9/2013 |
| CN | 203202661 | U | 9/2013 |
| CN | 203215483 | U | 9/2013 |
| CN | 101498411 | B | 11/2013 |
| CN | 203273663 | U | 11/2013 |
| CN | 203297980 | U | 11/2013 |
| CN | 203628464 | U | 12/2013 |
| CN | 203641919 | U | 6/2014 |
| CN | 204300818 | U | 4/2015 |
| CN | 104654142 | A | 5/2015 |
| CN | 204513161 | U | 7/2015 |
| CN | 204611541 | U | 9/2015 |
| CN | 204786225 | U | 11/2015 |
| CN | 204829578 | U | 12/2015 |
| CN | 103712135 | B | 4/2016 |
| CN | 205606362 | U | 9/2016 |
| CN | 206130742 | U | 4/2017 |
| CN | 103154606 | B | 5/2017 |
| CN | 206222112 | U | 6/2017 |
| CN | 107013845 | A | 8/2017 |
| CN | 107084343 | A | 8/2017 |
| DE | 9109828 | U1 | 2/1992 |
| DE | 199 47 208 | | 5/2001 |
| EP | 1 589 289 | | 10/2005 |
| EP | 1 672 155 | A1 | 6/2006 |
| EP | 1688663 | | 8/2006 |
| EP | 2 306 072 | A1 | 4/2011 |
| EP | 2 453 169 | A2 | 5/2012 |
| EP | 2 193 309 | B1 | 7/2012 |
| EP | 2 735 787 | A1 | 5/2014 |
| EP | 3 104 024 | A1 | 12/2016 |
| GB | 2325728 | | 12/1998 |
| GB | 2427020 | A | 12/2006 |
| GB | 2466875 | | 7/2010 |
| GB | 2471929 | | 1/2014 |
| GB | 2509772 | A | 7/2014 |
| JP | H02113002 | U | 9/1990 |
| JP | 2007091052 | A | 4/2007 |
| JP | 2007265961 | A | 10/2007 |
| JP | 2011060450 | A2 | 3/2011 |
| JP | 2012064551 | A2 | 3/2012 |
| JP | 2015002027 | A2 | 1/2015 |
| JP | 2015002028 | A2 | 1/2015 |
| JP | 2016219335 | A | 12/2016 |
| JP | 2017107699 | A2 | 6/2017 |
| KR | 1020110008796 | A | 1/2011 |
| KR | 1020120061625 | A | 6/2012 |
| MX | 2011002947 | A | 9/2011 |
| TW | 474382 | U | 1/2002 |
| WO | WO 2013/128896 | A1 | 9/2013 |

(56) References Cited

FOREIGN PATENT DOCUMENTS

WO WO 2015/000212 A1 1/2015
WO WO 2016152166 A2 9/2016

OTHER PUBLICATIONS

"Cree LMH2 LED Module with TrueWhite Technology," Cree Product Family Data Sheet. Dec. 21, 2011. 3 pages.
"Cree LMH2 LED Modules Design Guide," Cree Product Design Guide. 2011. 20 pages.
"Cree LMH2 LED Modules," Mouser Electronics. Accesssed at www.mouser.com/new/cree/creelmh2 on Sep. 9, 2012. 2 pages.
"LED Undercabinet Pocket Guide," ELCO Lighting. Nov. 2, 2016. 12 pages.
"Membrane Penetrations in Fire-Resistance Rated Walls," https://www.ul.com/wp-content/uploads/2014/04/ul_MembranePenetrations.pdf, Issue 1, 2009, published Feb. 26, 2010, 2 pages.
"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.
"Metallic Outlet Boxes," UL 514A, Underwriters Laboratories, Inc., Feb. 16, 2004 (Title Page Reprinted Aug. 10, 2007), 106 pages.
"Outlet Boxes for Use in Fire Rated Assemblies," https://www.ul.com/wp-content/uploads/2014/04/Ul_outletboxes.pdf, Apr. 2007, 2 pages.
"Portland Bi-Color, Warm White/Red," item:ILIM30941.lmtra Marine Products. 2012. 3 pages. Accessed athttp://www.imtra.com:80/0ade25fb-3218-4cae-a926-6abe64ffd93a/lighting-light-fixtures-downlights-3-to-4-inches-detail.htm on Jan. 25, 2013.
"Undercabinet Pucks, Xyris Mini LED Puck Light," ELCO Lighting. Sep. 2018. 1 page.
"VERSI LED Mini Flush," Lithonia Lghting. Sep. 2013. 6 pages. <https://www.zhagastandard.org/books/book18/>, Mar. 2017, 5 pages. Accessed on May 14, 2018.
2006 International Building Code, Section 712 Penetrations, Jan. 2006, 4 pages.
3 & 4" DLE Ser ies LED Sample Case Now Available. DMF Light. Issued Jan. 6, 2012. 1 page.
4" Octagon Concrete Boxes and Back Plates. Appleton. Accessed at www.appletonelec.com on May 6, 2019. 1 page.
Acrich COB Zhaga Module, Product Description, Seoul Semiconductor, Nov. 11, 2016, 39 pages.
Be seen in the best light. Lightolier by signify. Comprehensive 2019 Lighting Catalog. 114 pages.
BXUV.GuideInfo, Fire Resistance Ratings—ANSI/UL 263, UL Online Certifications Directory, last updated Nov. 3, 2016, 27 pages.
Canadian Office Action dated Aug. 11, 2017 from Canadian Application No. 2,941,051, 4 pages.
Canadian Office Action dated Dec. 23, 2013 from Canadian Application No. 2,778,581, 3 pages.
Canadian Office Action dated Dec. 6, 2016 from Canadian Application No. 2,879,629, 3 pages.
Canadian Office Action dated Feb. 1, 2016 from Canadian Application No. 2,879,486, 5 pages.
Canadian Office Action dated Jun. 12, 2017 from Canadian Application No. 2,927,601, 4 pages.
Canadian Office Action dated Mar. 22, 2016 from Canadian Application No. 2,879,629, 4 pages.
Canadian Office Action dated Mar. 9, 2017 from Canadian Application No. 2,931,588, 5 pages.
CEYY.GuideInfo, Outlet Boxes and Fittings Certified for Fire Resistance, UL Online Certifications Directory, last updated May 16, 2013, 2 pages.
Cooper Lighting HALO ML56 LED System Product Sheet. Mar. 2, 2015. Accessed at http://www.cooperindustries.com/content/dam/public/lighting/products/documents/halo/spec_sheets/halo-ml56600-80cri-141689-sss.pdf. 8 pages.
Corrected Notice of Allowance dated Oct. 10, 2019 from U.S. Appl. No. 16/016,040, 2 pages.
Corrected Notice of Allowance dated Sep. 27, 2019 from U.S. Appl. No. 15/167,682 , 2 pages.
Cree LED Lamp Family Sales Sheet—Better light is beautiful light , Apr. 24, 2017, 2 pages.
Cree® LMR2 LED Module. Product Family Data Sheet Cree 2011. 3 pages.
CS&E PCT Collaborative Search and Examination Pilot Upload Peer Contribution in International Patent Application No. PCT/US18/62868 dated Mar. 14, 2019, 61 pages.
CS&E PCT Collaborative Search and Examination Pilot Upload Peer Contribution in International Patent Application No. PCT/US18/67614 dated Apr. 24, 2019, 53 pages.
Delhi Rehab & Nursing Facility ELM16-70884. Vertex Innovative Solutions Feb. 25, 2016. 89 pages.
DLEI3 3" Recessed LED New Construction, IC. DMF Light. Issued Nov. 30, 2011. 2 pages.
DLEI411 4" Recessed LED New Construction, IC. DMF Light. Issued Nov. 30, 2011. 1 page.
DLEIR411 4" Recessed LED Remodel, IC. DMF Light. Issued Jun. 15, 2011. 1 page.
DLER411 4" Recessed LED Retrofit Module. DMF Light. Issued Jun. 15, 2011. 1 page.
DME Series Installation Instructions, Oct. 18, 2011, 2 pages.
DMF, Inc., "dmfLighting: LED Recessed Downlighting," DRD2 Product Brochure, Oct. 23, 2014, 50 pages.
DMF, Inc., "dmfLighting: LED Recessed Downlighting," Product Catalog, Aug. 2012, 68 pages.
DMF, Inc., "dmfLighting: LED Recessed Lighting Solutions," Info sheets, Mar. 15, 2012, 4 pages.
Ex-Parte Quayle Action dated Jun. 27, 2019 from U.S. Appl. No. 29/683,730, 5 pages.
Final Office Action dated Apr. 2, 2015 from U.S. Appl. No. 13/484,901, 13 pages.
Final Office Action dated Apr. 27, 2016 from U.S. Appl. No. 14/184,601, 19 pages.
Final Office Action dated Jan. 29, 2016 from U.S. Appl. No. 14/183,424, 21 pages.
Final Office Action dated Jul. 26, 2017 from U.S. Appl. No. 14/184,601, 18 pages.
Final Office Action dated Jun. 23, 2016 from U.S. Appl. No. 13/484,901, 18 pages.
Final Office Action dated Jun. 6, 2019 from U.S. Appl. No. 15/688,266, 7 pages.
Final Office Action dated Mar. 15, 2019 from U.S. Appl. No. 15/132,875,15 pages.
Final Office Action dated Mar. 17, 2020 for U.S. Appl. No. 29/653,142, 13 pages.
Final Office Action dated Oct. 3, 2019 from U.S. Appl. No. 29/678,482, 6 pages.
Final Office Action dated Sep. 27, 2019 from U.S. Appl. No. 16/200,393, 34 pages.
Halo, H7 LED Downlight Trims 49x Series, 6-inch LED Trims for Use with MI7x LED Modules, Cooper Lighting, ADV110422, rev. Aug. 12, 2011, 15 pages.
Halo, Halo LED H4 H7 Collection, SustainabLEDesign, Cooper Lighting, (emphasis on p. 18 "H7 Collection LED Modules—Halo LED H7 Module Features,") Mar. 28, 2012, 52 pages.
Halo, LED Module ML706x, Cooper Lighting, General Installation for All Modules/p. 1; Tether Installation/pp. 2-3; Installation into Halo H750x Series LED-only (Non-Screw Based), Recessed Fixture, p. 4, Oct. 20, 2009, 4 pages.
IC1JB Housing 4" IC-Rated New Construction Junction Box Housing. AcuityBrands. Accessed at https://www.acuitybrands.com/en/products/detail/845886/juno/ic1jb-housing/4-ic-rated-new-construction-junction-box-housing on Jun. 27, 2019.
Imtra Marine Lighting 2008 Catalog. 40 pages.
Imtra Marine Lighting 2009 Catalog. 32 pages.
Imtra Marine Lighting Spring 2007 Catalog. 36 pages.
International Search Report and Written Opinion in International Patent Application No. PCT/US18/39048 dated Dec. 14, 2018. 24 pages.

(56) References Cited

OTHER PUBLICATIONS

International Search Report and Written Opinion in International Patent Application No. PCT/US18/62868 dated Mar. 14, 2019, 13 pages.
International Search Report and Written Opinion in International Patent Application No. PCT/US18/67614 dated Apr. 25, 2019, 20 pages.
International Search Report and Written Opinion in International Patent Application No. PCT/US19/32281 dated Aug. 2, 2019, 18 pages.
International Search Report and Written Opinion in International Patent Application No. PCT/US2019/036477 dated Oct. 17, 2019, 15 pages.
International Search Report and Written Opinion in International Patent Application No. PCT/US2019/054220 dated Feb. 24, 2020, 23 pages.
International Search Report and Written Opinion in PCT/US2018/048357 dated Nov. 14, 2018, 13 pages.
KWIKBRACE® New Construction Braces for Lighting Fixtures or Ceiling Fans 1-1/2 in. Depth. Hubbel. Accessed at https://hubbellcdn.com/specsheet/926.pdf on Jun. 27, 2019. 1 page.
LED Book Pr ice Guide 2012. DMF Light. Issued Jun. 26, 2013. 3 pages.
Maxim Convert Fixture. LMXCAT1805 Maxim Main Catalog 2018 p. 639.
Maxim Lighting Trim Trifold LMXBRO1905 2019. Accessed at https://www.maximlighting.com/Upload/download/brochure/pdf/LMXBRO1905.pdf on Feb. 13, 2020. 2 pages.
Maxim Lighting Wafer Trifold Brochure LMXBRO1711 2017. Accessed at https://www.maximlighting.com/Upload/download/brochure/pdf/LMXBRO1711.pdf on Feb. 13, 2020. 2 pages.
Maxim Wafer. LMXCAT1805 Maxim Main Catalog 2018 pp. 636-638.
ML56 LED Lighting System 600 / 900 /1200 Series Halo. Cooper Lighting Brochure 2015. Accessed at https://images.homedepot-static.com/catalog/pdfImages/06/06d28f93-4bf6-45be-a35a-a0239606f227.pdf. 41 pages.
Non-Final Office Action dated Apr. 12, 2018 for U.S. Appl. No. 29/638,259, 5 pages.
Non-Final Office Action dated Apr. 2, 2020 for U.S. Appl. No. 16/522,275, 21 pages.
Non-Final Office Action dated Apr. 30, 2010 from U.S. Appl. No. 12/173,232, 13 pages.
Non-Final Office Action dated Apr. 4, 2019 from U.S. Appl. No. 29/678,482, 8 pages.
Non-Final Office Action dated Dec. 15, 2016 from U.S. Appl. No. 14/184,601, 18 pages.
Non-Final Office Action dated Dec. 30, 2019 from U.S. Appl. No. 16/653,497, 8 pages.
Non-Final Office Action dated Dec. 5, 2018 from U.S. Appl. No. 14/942,937, 13 pages.
Non-Final Office Action dated Feb. 7, 2019 from U.S. Appl. No. 16/200,393, 32 pages.
Non-Final Office Action dated Feb. 6, 2018 from U.S. Appl. No. 15/167,682, 9 pages.
Non-Final Office Action dated Jul. 20, 2015 from U.S. Appl. No. 14/184,601, 16 pages.
Non-Final Office Action dated Jul. 24, 2018 from U.S. Appl. No. 29/638,259, 5 pages.
Non-Final Office Action dated Jun. 11, 2019 from U.S. Appl. No. 15/901,738, 6 pages.
Non-Final Office Action dated Jun. 2, 2015 from U.S. Appl. No. 14/183,424, 20 pages.
Non-Final Office Action dated Jun. 25, 2018 for U.S. Appl. No. 29/541,565, 10 pages.
Non-Final Office Action dated Mar. 15, 2010 from U.S. Appl. No. 12/100,148, 8 pages.
Non-Final Office Action dated May 16, 2018 for U.S. Appl. No. 15/132,875, 18 pages.
Non-Final Office Action dated May 17, 2017 from U.S. Appl. No. 14/183,424, 20 pages.
Non-Final Office Action dated Oct. 16, 2014 from U.S. Appl. No. 13/484,901, 11 pages.
Non-Final Office Action dated Oct. 24, 2018 for U.S. Appl. No. 15/688,266, 14 pages.
Non-Final Office Action dated Sep. 15, 2015 from U.S. Appl. No. 13/484,901, 16 pages.
Non-Final Office Action dated Sep. 5, 2014 from U.S. Appl. No. 13/791,087, 8 pages.
Non-Final Office Action dated Sep. 6, 2017 from U.S. Appl. No. 14/726,064, 8 pages.
Notice of Allowance dated Apr. 1, 2019 from U.S. Appl. No. 15/167,682, 7 pages.
Notice of Allowance dated Apr. 17, 2019 from U.S. Appl. No. 29/678,478, 7 pages.
Notice of Allowance dated Apr. 8, 2019 from U.S. Appl. No. 29/653,142, 8 pages.
Notice of Allowance dated Aug. 23, 2017 from Canadian Application No. 2,879,629, 1 page.
Notice of Allowance dated Feb. 15, 2019 from U.S. Appl. No. 15/947,065 , 9 pages.
Notice of Allowance dated Feb. 5, 2020 from U.S. Appl. No. 15/901,738 , 8 pages.
Notice of Allowance dated Feb. 5, 2020 from U.S. Appl. No. 29/678,482 , 13 pages.
Notice of Allowance dated Feb. 8, 2019 from U.S. Appl. No. 29/541,565, 5 pages.
Notice of Allowance dated Jan. 16, 2015 from U.S. Appl. No. 29/467,026, 9 pages.
Notice of Allowance dated Jan. 2, 2019 from U.S. Appl. No. 29/541,565, 6 pages.
Notice of Allowance dated Jan. 28, 2019 from U.S. Appl. No. 29/664,471, 8 pages.
Notice of Allowance dated Jan. 30, 2015 from U.S. Appl. No. 13/791,087, 9 pages.
Notice of Allowance dated Jul. 31, 2019 from U.S. Appl. No. 15/167,682 , 7 pages.
Notice of Allowance dated Jun. 12, 2019 from U.S. Appl. No. 16/016,040, 8 pages.
Notice of Allowance dated Mar. 24, 2016 from U.S. Appl. No. 14/247,149, 8 pages.
Notice of Allowance dated Mar. 26, 2018 for U.S. Appl. No. 14/184,601, 10 pages.
Notice of Allowance dated May 10, 2018 from U.S. Appl. No. 14/726,064, 7 pages.
Notice of Allowance dated May 22, 2018 from U.S. Appl. No. 14/183,424, 9 pages.
Notice of Allowance dated Nov. 27, 2018 from U.S. Appl. No. 15/167,682, 11 pages.
Notice of Allowance dated Oct. 1, 2019 from U.S. Appl. No. 14/942,937, 7 pages.
Notice of Allowance dated Oct. 16, 2019 from U.S. Appl. No. 15/132,875, 12 pages.
Notice of Allowance dated Oct. 21, 2016 from U.S. Appl. No. 13/484,901, 7 pages.
Notice of Allowance dated Oct. 4, 2018 from U.S. Appl. No. 15/947,065 , 9 pages.
Notice of Allowance dated Oct. 9, 2018 from U.S. Appl. No. 29/653,142, 7 pages.
Notice of Allowance dated Sep. 11, 2019 from U.S. Appl. No. 29/653,142, 6 pages.
Notice of Allowance dated Sep. 19, 2018 from U.S. Appl. No. 15/167,682, 7 pages.
Notice of Allowance dated Sep. 19, 2019 from U.S. Appl. No. 16/016,040, 7 pages.
Notice of Allowance dated Sep. 21, 2018 from U.S. Appl. No. 29/645,941, 5 pages.
OneFrame Recessed LED Downlight. Dmflighting.com. Published Jun. 6, 2018. Retrieved at https://www.dmflighting.com/product/oneframe on Jun. 6, 2018. 11 pages.
RACO 4 in. Octagon Welded Concrete Ring, 3-1/2 in. Deep with 1/2 and 3/4 in. Knockouts and ilcludes 890 cover (20-Pack).

(56) References Cited

OTHER PUBLICATIONS

Model # 280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.
RACO 4 in. Octagon Welded Concrete Ring, 6 in. Deep with 1/2 and 3/4 in. Knockouts (10-Pack). Model # 276. Accessed at https://www.homedepot.com/p/RACO-4-in-Octagon-Welded-Concrete-Ring-6-in-Deep-with-1-2-and-3-4-in-Knockouts-10-Pack-276/203638675 on Jan. 16, 2019. 4 pages.
RACO Commercial, Industrial and Residential Electrical Products. Hubbell. Accessed at www.Hubbell-RTB.com on May 6, 2019. 356 pages.
Ridgway-Barnes, SlimSurface LED Downlight: One of the thinnest LED surface mount downlights in the market. Philips Lighting Blog. Oct. 28, 2014. Accessed at http://applications.nam.lighting.philips.com/blog/index.php/2014/10/28/slimsurface-led-downlight-one-of-the-thinnest-led-surface-mount-downlights-in-the-market/. 3 pages.
SlimSurface LED S5R, S7R & S10R Round 5", 7" and 10" Apertures. Lightolier by Signify. Nov. 2018. 9 pages.
SlimSurface surface mount downlighting. Philips Lightolier 2018. 8 pages.
Specification & Features 4" Octagonal Concrete Box Covers. Orbit Industries, Inc. Accessed at https://www.orbitelectric.com on May 6, 2019. 1 page.
Supplemental Notice of Allowance dated Aug. 5, 2019 from U.S. Appl. No. 15/947,065, 2 pages.
Switch and Outlet Boxes and Covers Brochure. Appelton 2010. 77 pages.
Civil Action No. 2:18-cv-07090. Complaint For Infringement And Unfair Competition. *DMF, Inc.* v. *AMP Plus, Inc. d/b/a ELCO Lighting.* 52 pages. Dated Aug. 15, 2018.
Petition for Inter Partes Review of U.S. Pat. No. 9,964,266 Pursuant to 37 C.F.R. § 42.100 et seq. *AMP Plus Inc. dbd ELCO Lighting* v. *DMF, Inc,* IPR2019-01094 filed May 17, 2019. 108 pages.
IPR2019-01094 Exhibit 1001. U.S. Pat. No. 9,964,266 ("the '266 Patent"). 14 pages.
IPR2019-01094 Exhibit 1002. Declaration of Eric Bretschneider, Ph.D. ("Bretschneider"). 107 pages.
IPR2019-01094 Exhibit 1003. Curriculum Vitae of Dr. Bretschneider. 11 pages.
IPR2019-01094 Exhibit 1004. Excerpts from the File History of U.S. Pat. No. 9,964,266. 105 pages.
IPR2019-01094 Exhibit 1005. Imtra 2011 Marine Lighting Catalog—Advanced LED Solutions ("Imtra 2011"). 40 pages.
IPR2019-01094 Exhibit 1006. Imtra 2007 Marine Lighting Catalog ("Imtra 2007"). 36 pages.
IPR2019-01094 Exhibit 1007. U.S. Pat. No. 9,366,418 ("Gifford"). 9 pages.
IPR2019-01094 Exhibit 1008. Declaration of Colby Chevalier ("Chevalier"). 89 pages.
IPR2019-01094 Exhibit 1009. U.S. Pat. No. 7,102,172 ("Lynch"). 41 pages.
IPR2019-01094 Exhibit 1010. Illuminating Engineering Society, ANSI RP-16-10, Nomenclature and Definitions for Illuminating Engineering (approved as an American National Standard Jul. 15, 2005, approved by the IES Board of Directors Oct. 15, 2005). 4 pages.
IPR2019-01094 Exhibit 1011. Underwriters Laboratories Inc. Standard for Safety, Standard UL-8750, entitled Light Emitting Diode (LED) Equipment for Use in Lighting (1st ed. 2009). 5 pages.
IPR2019-01094 Exhibit 1012. Celanese CoolPoly® D5502 Thermally Conductive Liquid Crystalline Polymer Specification ("CoolPoly"). 1 page.
IPR2019-01094 Exhibit 1013. Illuminating Engineering Society of North America, IES Lighting Handbook (John E. Kaufman and Howard Haynes eds., Application vol. 1981) ("Lighting Handbook"). 5 pages.
IPR2019-01094 Exhibit 1014. California Energy Commission, PIER Lighting Research Program: Project 2.3 Low-profile LED Luminaires Final Report (Prepared by Lighting Research Center, Jan. 2005) ("PIER LRP"). 70 pages.
IPR2019-01094 Exhibit 1015. Jim Sinopoli, Using DC Power to Save Energy and End the War on Currents, GreenBiz (Nov. 15, 2012), https://www.greenbiz.com/news/2012/11/15/using-dc-power-save-energy-end-war-currents ("Sinopoli"). 6 pages.
IPR2019-01094 Exhibit 1016. Robert W. Johnson, "Thought Leadership White Paper: AC Versus DC Power Distribution" (Nov. 2012) ("Johnson"). 10 pages.
IPR2019-01094 Exhibit 1017. Lumileds, LUXEON Rebel General Purpose Product Datasheet, Specification DS64 (2016) ("Luxeon Rebel"). 26 pages.
IPR2019-01094 Exhibit 1018. U.S. Pat. No. 8,454,204 ("Chang"). 11 pages.
IPR2019-01094 Exhibit 1019. U.S. Department of Energy, CALiPER Benchmark Report: Performance of Incandescent A-Type and Decorative Lamps and LED Replacements (prepared by Pacific National Laboratory, Nov. 2008) ("CALiPER 2008"). 25 pages.
IPR2019-01094 Exhibit 1020. U.S. Pat. No. 3,836,766 ("Auerbach"). 13 pages.
IPR2019-01094 Exhibit 1021. U.S. Department of Energy, CALiPER Application Summary Report 16: LED BR30 and R30 Lamps (prepared by Pacific Northwest National Laboratory, Jul. 2012) ("CALiPER 2012"). 26 pages.
IPR2019-01094 Exhibit 1022. Sandia National Laboratories, Sandia Report: "The Case for a National Research Program on Semiconductor Lighting" (Jul. 2000) ("Haitz"). 24 pages.
IPR2019-01094 Exhibit 1023. Sylvania, Post Top Street Light LED Retrofit Kit Specification, LED40POST (2009) ("Sylvania"). 4 pages.
IPR2019-01094 Exhibit 1024. Webster's New Collegiate Dictionary (1973) ("Webster's"). 2 pages.
IPR2019-01094 Exhibit 1025. 3M Wire Connectors and Tools Catalog 2013 ("3M Catalog"). 22 pages.
IPR2019-01094 Exhibit 1026. Wakefield Semiconductor Heat Sinks and Thermal Products 1974 Catalog ("Wakefield"). 3 pages.
IPR2019-01094 Exhibit 1027. U.S. Department of Energy, Solid-State Lighting Research and Development Portfolio: Multi-Year Program Plan FY'07-FY' 12 (prepared by Navigant Consulting, Inc., Mar. 2006) ("DOE 2006"). 129 pages.
IPR2019-01094 Exhibit 1028. U.S. Department of Energy, Solid-State Lighting Research and Development: Multi-Year Program Plan (Apr. 2013) ("DOE 2013"). 89 pages.
Declaration of Colby Chevalier from Central District of California Civil Docket for Case #: 2:18-cv-07090-CAS-GJS filed Jun. 3, 2019, signed Jun. 3, 2019. 2 pages.
Docket Listing in Inter Partes Review of U.S. Pat. No. 9,964,266. Docket Navegator *AMP Plus, Inc. d/b/a Elco Lighting et al* v. *DMF, Inc.* PTAB-IPR2019-01094. Downloaded Mar. 25, 2020. 4 pages.
Petition for Inter Partes Review of U.S. Pat. No. 9,964,266 Pursuant to 37 C.F.R. § 42.100 et seq. *AMP Plus Inc. dbd ELCO Lighting* v. *DMF, INC,* PTAB-IPR2019-01500 filed Aug. 14, 2019. 99 pages.
Docket Listing in Inter Partes Review of U.S. Pat. No. 9,964,266 . *AMP Plus, Inc. d/b/a ELCO Lighting et al* v. *DMF, Inc.* PTAB-IPR2019-01500. Downloaded Mar. 25, 2020. 3 pages.
Docket Listing in Civil Action No. 2:18-cv-07090. *DMF, Inc.* v. *AMP Plus, Inc. d/b/a ELCO Lighting et al* CDCA-2-18-cv-07090. Downloaded on Mar. 25, 2020. 39 pages.
Civil Action No. 2:19-cv-4519.Complaint For Patent Infringement. *DMF, Inc.* v. *AMP Plus, Inc. d/b/a ELCO Lighting.* 52 pages dated May 22, 2019. 23 pages.
Docket Listing in Civil Action No. 2:19-cv-4519. *DMF Inc* v. *AMP Plus, Inc. d/b/a ELCO Lighting et al* CDCA-2-19-cv-04519. Downloaded on Mar. 25, 2020. 3 pages.
Decision Denying Institution of Inter Partes Review of U.S. Pat. No. 9,964,266 in IPR2019-01500 dated Mar. 17, 2020. 21 pages.
Defendants' Notice of Prior Art Pursuant To 35 U.S.C. § 282 in Civil Action No. 2:18-cv-07090-CAS-GJS dated Feb. 28, 2020. 7 pages.

(56) References Cited

OTHER PUBLICATIONS

Defendant AMP Plus, Inc.'s Opposition to DMF's Motion for Summary Judgement in Civil Action No. 2:18-cv-07090-CAS-GJS filed Feb. 10, 2020. 32 pages.
Declaration of Eric Bretschneider, Ph.D In Support of Amp Plus, Inc.'s Opposition to Dmf, Inc.'s Motion for Partial Summary Judgment in Civil Action No. 2:18-cv-07090-CAS-GJS filed Feb. 10, 2020. 210 pages.
Plaintiff DMF's Reply in Support Of Motion For Partial Summary Judgment in Civil Action No. 2:18-cv-07090-CAS-GJS filed Feb. 18, 2020. 33 pages.
Declaration of James R. Benya In Support of Plaintiff DMF's Motion for Summary Judgment in Civil Action No. 2:18-cv-07090-CAS-GJS filed Feb. 3, 2020. 193 pages.
Underwriters Laboratories Inc. Standard for Safely. UL 1598. Luminaires Jan. 11, 2020. 12 pages.
Exceptional LED Lighting Technology Product Portfolio. LightingScience 2012. 11 pages.
"Cree LMH2 LED Modules," Mouser Electronics. Sep. 9, 2012. 4 pages.
Slim Line Disc. EYE LEDs Specification Sheet 2012. 2 pages.
HiBay LED Heat Sink. Wakefield-vette. Dec. 11, 2017. 1 pages.
Thermal Management of Cree® XLamp® LEDs. Cree Application Note. 2004. 19 pages.
Imtra Marine Lighting Fall 2007 Catalog. 32 pages.
Notice of Allowance dated May 18, 2020 from U.S. Appl. No. 15/901,738 , 7 pages.
Non-Final Office Action dated May 20, 2020 for U.S. Appl. No. 15/688,266, 6 pages.
Non-Final Office Action dated May 26, 2020 for U.S. Appl. No. 16/719,361, 10 pages.
Maxim Lighting International, "Wafer LED 7" RD 3000K Wall/Flush Mount, undated.
Maxim Lighting International, "Convert LED Flush Mount", undated.
Maxim Lighting International, "Views of the Wafer Flush Mount", undated.
Maxim Lighting International, "Product/Drawing Specification Sheet", undated.
International Search Report and Written Opinion in PCT/US2020/017331 dated Jun. 22, 2020, 16 pages.
Taiwan Office Action and translation thereof dated Jun. 12, 2020 from Taiwan Application No. 108116564, 8 pages.
Access Lighting Installation Instructions. No. 20870LEDD/20871LEDD/20872LEDD. Dec. 16, 2019. 2 pages.
Model No. 20870LEDD-WH/ACR Infinite Specification Sheet. Access Lighting. Apr. 9, 2020. 1 page.
Notice of Allowance dated Apr. 9, 2020 from U.S. Appl. No. 16/653,497, 7 pages.
Notice of Allowance dated Jul. 10, 2020 from U.S. Appl. No. 29/694,475, 6 pages.
Corrected Notice of Allowability dated Oct. 25, 2018 from U.S. Appl. No. 14/183,424, 3 pages.
Dmf DRD2 Recessed LED Downlight General Retrofit Junction Box Dated: Dec. 18, 2015 Downloaded Jul. 28, 2018, from https://www.a Iconlighting.com/specsheets/DMF/DRD2-Junction-Box-Retrofit-Spec-Sheet .pdf, 6 pages.
Dmf DRD2 Recessed LED Downlight General New Construction 4", 5", 6" Aperture Dated: Aug. 31, 2016 Downloaded Jul. 28, 2018, from https://www. cansandfans.com/sites/default/files/DRD2-General-New-Construction-Spec-Sheet_7_0 .pdf, 9 pages.
Mar. 5, 2016—The DMF Lighting DRD2 Recessed LED Downlight General Retrofit Junction Box—Wet Location Rated is the ideal solution for Commercial LED recessed lighting retrofit applications. web cache https://ww w.alconlighting.com/dmf-drd2m.html (downloaded Jul. 28, 2018), 6 pages.
Ex Parte Quayle Office Action dated Oct. 16, 2018 for U.S. Appl. No. 29/663,037, 7 pages.
Notice of Allowance dated Nov. 19, 2018 from U.S. Appl. No. 29/663,037, 5 pages.
Notice of Allowance dated Nov. 15, 2018 from U.S. Appl. No. 29/663,040, 5 pages.
LED modules advance in performance, standardization questions persist (MAGAZINE). LEDs Magazine. Oct. 29, 2013. Accessed at https://www.ledsmagazine.com/leds-ssl-design/modular-light-engines/article/16695073/led-modules-advance-in-performance-standardization-questions-persist-magazine. 9 pages.
Notice of Allowance dated Jul. 20, 2020 from U.S. Appl. No. 29/648,046, 5 pages.
Octagon Concrete Box Cover with (3) 1/2 in. & (2) 3/4 in. Conduit Knockouts. Garvin. Accessed at https://www.garvinindustries.com/covers-and-device-rings/concrete-slab-box-covers-adaptor-rings/flat-covers-all-styles/cbp?gclid=Cj0KCQjw9b_4BRCMARIsADMUIypJc0K80UHdDTI9C5m4BDzR3U87PRYV1NdQIBFxEWQ2I_3otTCTqEkaAi_DEALw_wcB on Jul. 20, 2020. 1 page.
Notice of Allowance dated Jul. 28, 2020 from U.S. Appl. No. 16/719,361, 8 pages.
Notice of Allowance dated Jul. 29, 2020 from U.S. Appl. No. 16/522,275, 8 pages.
Non-Final Office Action dated Aug. 19, 2020 for U.S. Appl. No. 16/886,365, 16 pages.
Notice of Allowance dated Sep. 8, 2020 from U.S. Appl. No. 29/678,482, 5 pages.
Corrected Notice of Allowance dated Sep. 11, 2020 from U.S. Appl. No. 16/719,361, 2 pages.
Canadian Office Action in Application No. 2931588 dated Aug. 13, 2020, 5 pages.
Corrected Notice of Allowance dated Sep. 14, 2020 from U.S. Appl. No. 16/522,275, 2 pages.
Notice of Allowance dated Sep. 22, 2020 from U.S. Appl. No. 29/683,730, 6 pages.
Notice of Allowance dated Sep. 22, 2020 from U.S. Appl. No. 29/653,142, 6 pages.
Notice of Allowance dated Oct. 27, 2020 from U.S. Appl. No. 29/648,046, 5 pages.
Notice of Allowance dated Oct. 27, 2020 from U.S. Appl. No. 29/694,475, 5 pages.
Notice of Allowance dated Nov. 10, 2020 from U.S. Appl. No. 29/688,143, 6 pages.
Notice of Allowance dated Nov. 10, 2020 from U.S. Appl. No. 29/688,172, 6 pages.
Non-Final Office Action dated Nov. 30, 2020 from U.S. Appl. No. 17/000,702, 7 pages.
Notice of Allowance dated Dec. 2, 2020 from U.S. Appl. No. 29/746,262, 6 pages.
International Search Report and Written Opinion in PCT/US2020/050767 dated Dec. 9, 2020, 25 pages.
Non-Final Office Action dated Dec. 16, 2020 from U.S. Appl. No. 17/080,080, 28 pages.
Canadian Office Action in Application No. 2941051 dated Dec. 8, 2020, 5 pages.
Final Office Action dated Jan. 11, 2021 from U.S. Appl. No. 15/688,266, 7 pages.
Non-Final Office Action dated Jan. 11, 2021 from U.S. Appl. No. 16/725,606, 7 pages.
Non-Final Office Action dated Jan. 13, 2021 from U.S. Appl. No. 17/085,636, 14 pages.
Notice of Allowance dated Jan. 15, 2021 from U.S. Appl. No. 17/000,702, 7 pages.
Notice of Allowance dated Jan. 22, 2021 from U.S. Appl. No. 17/080,080, 14 pages.
Notice of Allowance dated Jan. 22, 2021 from U.S. Appl. No. 16/886,365, 7 pages.
Final Office Action dated Feb. 5, 2021 from U.S. Appl. No. 16/200,393, 7 pages.
"Electrical Boxes" accessed at http://electrical-inspector.blogspot.com/2013/06/electrical-boxes.html Jun. 22, 2013 retrieved from Wayback Machine Archinve.org on Jan. 25, 2021. 12 pages.
"Electrical Boxes Volume and Fill Calculations" accessed at http://electrical-inspector.blogspot.com/2013/06/electrical-boxes-Volume-and-Fill-Calculations.html Jun. 22, 2013 retrieved from Wayback Machine Archinve.org on Jan. 25, 2021. 8 pages.

(56) References Cited

OTHER PUBLICATIONS

U.S. Appl. No. 61/881,162, filed Sep. 23, 2013. Prioirty application to US Publication No. 2015/0085500 to Cooper et al. 31 pages.
Non-Final Office Action dated Jan. 19, 2021 from U.S. Appl. No. 17/099,650, 15 pages.
Supplemental Notice of Allowance dated Mar. 10, 2021 from U.S. Appl. No. 16/886,365, 2 pages.
Notice of Allowance dated Apr. 6, 2021 from U.S. Appl. No. 16/200,393, 11 pages.
Non-Final Office Action dated Apr. 12, 2021 from U.S. Appl. No. 29/694,475, 11 pages.
Notice of Allowance dated Apr. 13, 2021 from U.S. Appl. No. 16/725,606, 7 pages.
Notice of Allowance dated Apr. 26, 2021 from U.S. Appl. No. 17/080,080, 11 pages.
Corrected Notice of Allowance dated Apr. 28, 2021 from U.S. Appl. No. 16/725,606, 2 pages.
Notice of Allowance dated May 5, 2021 from U.S. Appl. No. 17/085,636, 8 pages.
Notice of Allowance dated May 14, 2021 from U.S. Appl. No. 16/881,686, 8 pages.
Cree LMH2 LED Modules Product Family Data Sheet. Cree 2011-2014, 18 pages.
Cree LMH2 LED Modules Design Guide. Cree 2011-2015, 23 pages.
Brochure of Elco EL49A, EL49ICA, EL49RA modules. ELCO Lighting Nov. 25, 2009. 1 page.
Image of Elco E347/247 module identified by Elco in response to DMF's Request for Production in Civil Action No. 2:18-cv-07090-CAS-GJS on Aug. 28, 2019. 1 page.
Screenshots from the Deposition of Brandon Cohen in Civil Action No. 2:18-cv-07090-CAS-GJS. Conducted Sep. 2, 2020. 8 pages.
Defendant AMP Plus, Inc.'s Initial Disclosure and Designation of Expert Witnesses in Civil Action No. 2:19-CV-4519-CAS. 37 pages.
Defendant AMP Plus, Inc. D/B/A Elco Lighting's Supplemental Responses to Plaintiff DMF, Inc.'s First Set of Interrogatories (Nos. 1-16) in Civil Action No. 2:19-CV-4519-CAS, Redacted. 13 pages.
Final Written Decision in IPR2019-01094 dated Nov. 19, 2020, 58 pages.
U.S. Appl. No. 29/688,172, filed Apr. 18, 2019, Danesh et al.
U.S. Appl. No. 29/688,143, filed Apr. 18, 2019, Danesh et al.
U.S. Appl. No. 16/883,144, filed May 26, 2020, Nikooyan et al.
U.S. Appl. No. 29/696,830, filed Jul. 1, 2019, Kopitzke.
U.S. Appl. No. 16/182,481, filed Nov. 6, 2018, Kopitzke.
U.S. Appl. No. 29/762,016, filed Dec. 14, 2020, Williams et al.

OUTER CASING FOR A RECESSED LIGHTING FIXTURE

CROSS-REFERENCE TO RELATED APPLICATIONS

This application is a Continuation Application of U.S. application Ser. No. 15/132,875, filed Apr. 19, 2016, entitled "OUTER CASING FOR A RECESSED LIGHTING FIXTURE," which claims priority to U.S. Provisional Patent Application No. 62/151,308, filed Apr. 22, 2015, entitled "OUTER CASING FOR A RECESSED LIGHTING FIXTURE." Each of the aforementioned applications is incorporated by reference herein in its entirety.

FIELD

An embodiment of the invention relates to an outer casing for a recessed lighting fixture that houses a unified light source module and driver, and that is directly attached to a set of hangar bars without the use of a horizontally oriented frame. Other embodiments are also described.

BACKGROUND

Recessed lighting fixtures are typically installed or mounted into an opening in a ceiling or a wall. Modern recessed lighting fixtures generally consist of a trim, a light source module, a driver circuit, a legacy incandescent "can" in which the light source module and driver circuit are housed, a junction box, and a set of hangar bars to which a horizontally oriented frame or platform is directly attached. The can and junction box are attached to the horizontally oriented platform. The combination of the can and junction box attached to the horizontal platform is bulky and expensive to manufacture. Moreover, the can and the junction box once attached to the platform cannot be adjusted vertically or horizontally.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments are described with reference to the appended drawings. While numerous details are set forth, it is understood that some embodiments of the invention may be practiced without these details. In other instances, well-known circuits, structures, and techniques have not been shown in detail so as not to obscure the understanding of this description.

Figure 1:
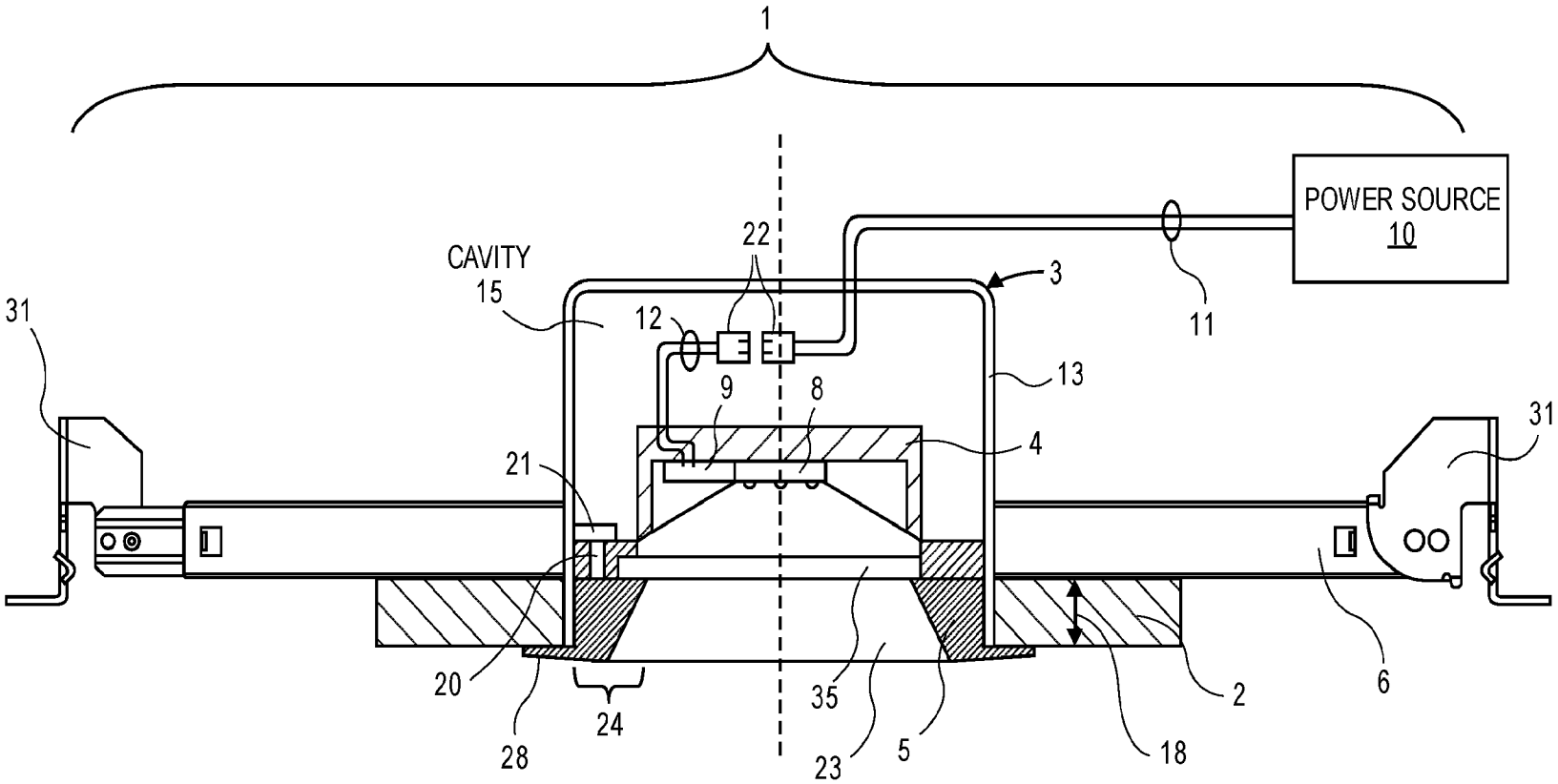
FIG. 1 shows a front cross-section view of an outer casing, with a unified casting positioned inside the outer casing, coupled to hangar bars according to one embodiment.

FIG. 1 shows a cross-section view of a recessed lighting fixture or system 1 installed so that the exposed edge of the ceiling or wall 2, where a hole is formed, is covered. The recessed lighting fixture 1 may include an outer casing 3, a unified casting 4, a trim 5, a set of hangar bars 6, and a set of hangar holders 7 (shown in a side view in FIG. 2 and also in FIG. 4). The unified casting 4 may house both a light source module 8 (e.g. a module of several LED elements) and a driver 9 in a single compact unit. The trim 5 serves the primary purpose of covering the exposed edge of the ceiling or wall where a hole is formed in which the recessed lighting fixture 1 resides while still allowing light from a light source module 8 to be emitted into a room through an aperture 23 of the trim 5 to illuminate the room. In doing so, the trim 5 helps the recessed lighting fixture 1 appear seamlessly integrated into the ceiling or wall. The trim 5 may be attached to the outer casing 3 also to hide at least the periphery at the bottom edge of the outer casing 3 from view. This can be seen in FIG. 1 where a flange 28 extends outward from a trim base 24 so as to hide from view (below the light fixture) the bottom edge of the casing 3. As will be described in further detail below, the recessed lighting fixture 1 provides a more compact and cost effective design that also allows the outer casing 3 to be moved so that its position relative to the hangar bars 6 can be adjusted, while complying with various building and safety codes/regulations. Each of the elements of the recessed lighting fixture 1 will be explained by way of example below.

Instead of using a junction box that is mounted along with a can to a horizontal platform (which is in turn attached to a joist or other structural member behind the ceiling or wall 2), as is already known in the art, the outer casing 3 may be used in such a way that obviates the need for a separate junction box and that also eliminates the horizontal platform. As seen FIG. 2 and in FIG. 3, the outer casing 3, and in particular its sidewall 13, is directly attached to a hangar bar 6 via a hangar holder 7. The hangar bar 6 is in turn attached directly to a joist, beam, or other structural member behind the ceiling or wall 2 at a mounting block 31*a*, 31*b*, so that the aperture 23 of the trim 5 will be aligned with and covers the hole in the wall 2. The outer casing 3 may serve as both a protective barrier between wall insulation materials and wiring junctions inside its cavity, and as a luminaire enclosure. As shown in FIG. 1, the outer casing 3 is a structure that separates the inner components of the recessed lighting fixture 1, i.e., those that are located inside the outer casing 3, including electrical wires/cables 11, 12 and connectors 22 that electrically connect a driver 9 in the unified casting 4 to an external power source 10, from items such as thermal/heat insulation materials and the power source 10 that are outside of the outer casing 3 and inside a ceiling or crawl space in which the outer casing has been installed. In one embodiment, the outer casing 3 may accommodate a wall thickness 18 of the ceiling or wall 2 of ½ inch to 2½ inches. The outer casing 3 may have a fire rating of up to two hours without any need for modification, where the fire rating is described in the National Electrical Code (NEC) and by the Underwriters Laboratories (UL) such as specified in UL 263. The outer casing 3 may receive electrical wires 11 into its cavity from the power source 10, such as an electrical power distribution system (e.g., 120 VAC or 277 VAC) within a building or structure in which the recessed lighting fixture 1 is installed. There may be one or more wire connectors 22 inside the outer casing 3 that join one or more wires 11 which carry 120/277 VAC power and that extend into the casing, to deliver 120/277 VAC power from a circuit breaker or wall switch to the driver 9. The electrical wires 11 from the power source 10 may thus be connected inside the outer casing 3 to corresponding wires 12 of the driver 9 which is inside the unified casting 4, as will be described in greater detail below.

Figure 4:
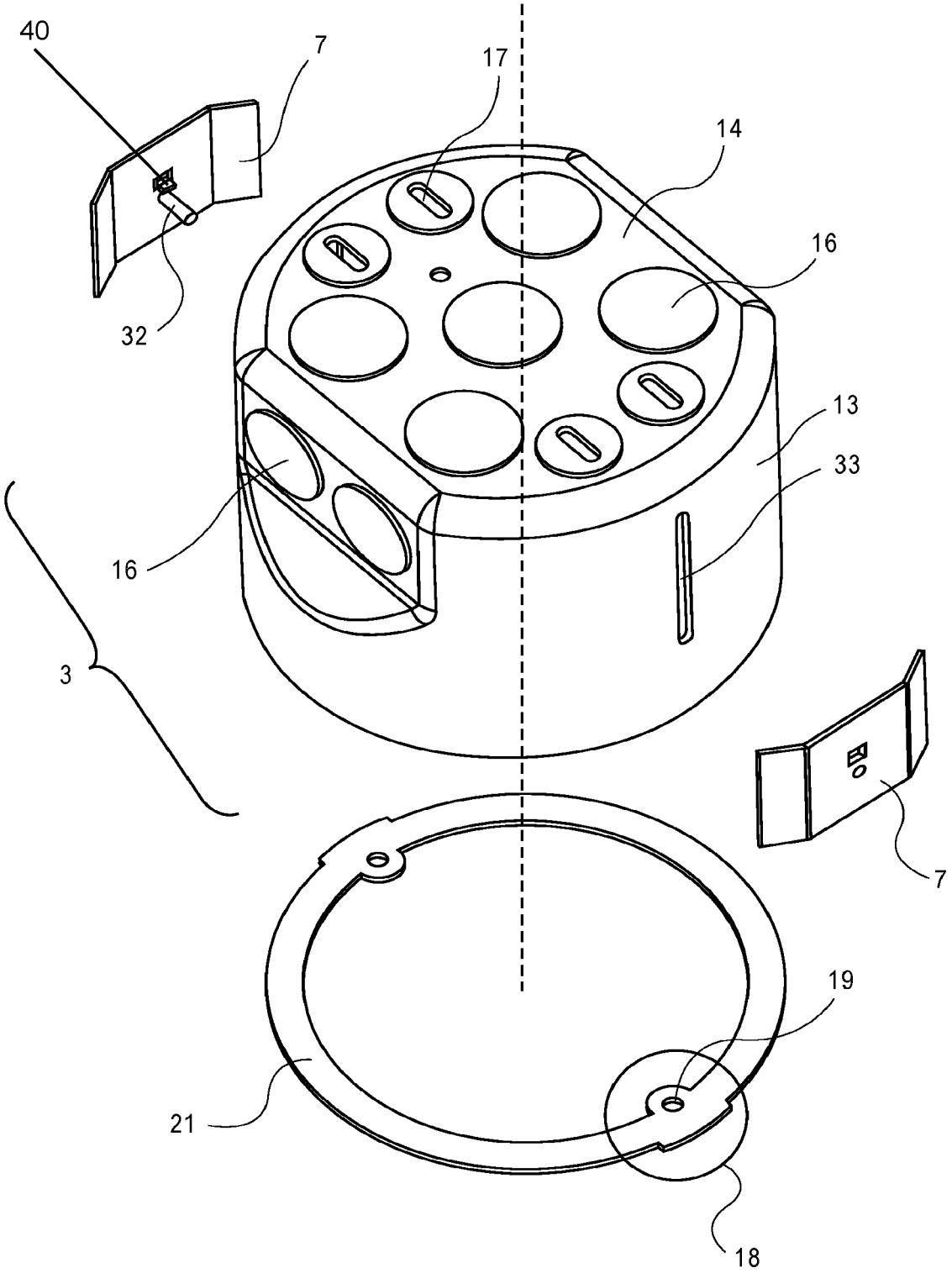
FIG. 4 shows an overhead perspective view of an outer casing, hangar holders, and a ring according to one embodiment.
Figure 5:
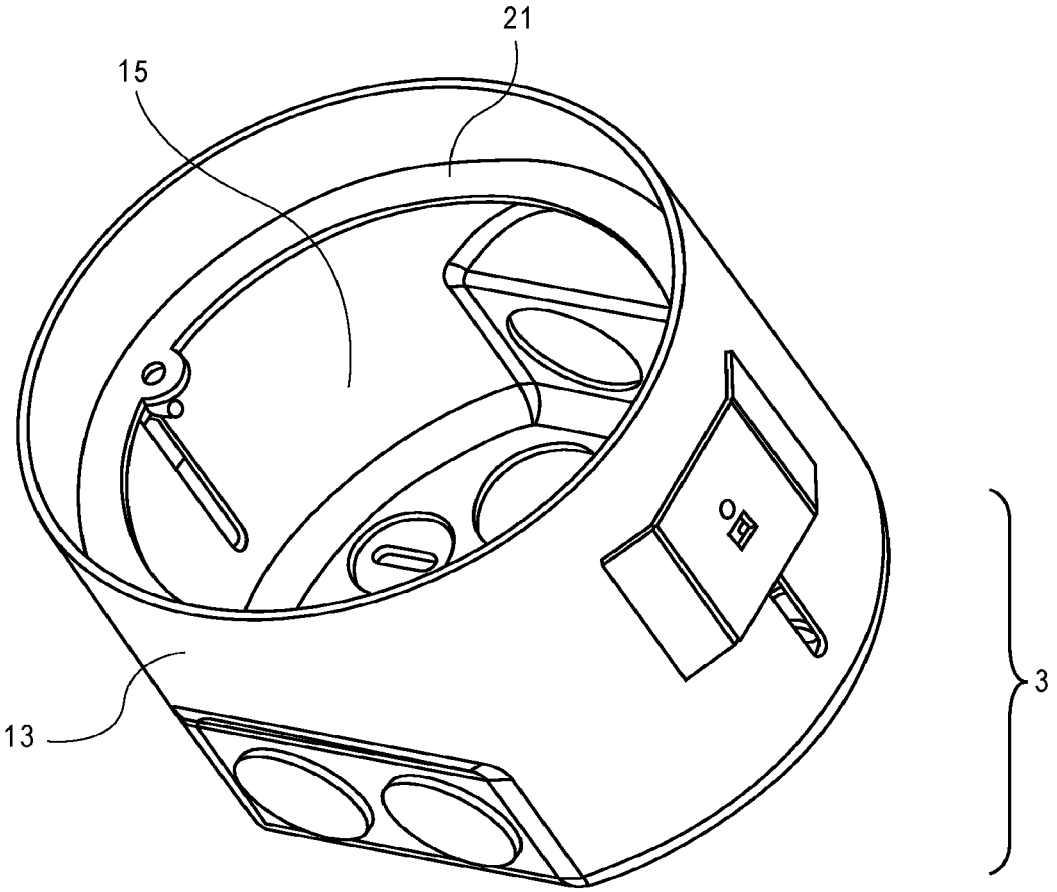
FIG. 5 shows an underneath perspective view of the embodiment of FIG. 4 with the ring inserted into the cavity of the outer casing.

As shown in FIG. 4, the outer casing 3 may have a side wall 13 that extends from and is joined at its upper edge (or upper end) to a closed base end 14, which together define a cavity 15 therein (see FIG. 1 and FIG. 5). The side wall 13 may surround the cavity 15, with its lower edge (or lower end) defining the perimeter of an opening through which various components can be placed inside the cavity 15, including for example, a ring 21, the unified casting 4, and the trim 5, as shown in FIG. 4, FIG. 5, and in FIG. 1. In one embodiment, as shown in FIG. 5, the lower edge (lower end) of the sidewall 13 is devoid of any tabs that extend inward (towards a center vertical axis that is shown as a dotted line). While the side wall 13 is depicted in the relevant figures here as being cylindrical, in other embodiments the side wall 13 of the outer casing 3 have any suitable shape, including a polyhedron, ellipsoid, frusto-conical, or otherwise curved. The cavity 15 that is formed in the outer casing 3 is larger than the outside dimensions of the unified casting 4 such that the entirety of the unified casting 4 fits into the cavity 15—see the front and side views in FIG. 1 and FIG. 2. The unified casting 4 may or may not come into direct contact with the side wall 13 of the outer casing 3. The outer casing 3 is less than 5 inches in height between its base end and the other end of its sidewall.

As seen in FIG. 4, the outer casing 3 may have on its base end 14 one or more knockouts 16 as shown. The knockouts 16 may be punched through and removed to leave an opening behind on the base end 14, for electrical wires 11 or 12 to be inserted through the opening (which wires serve to deliver power to the driver 9). As shown in the top view of FIG. 3, one or more knockouts 16 may also have smaller openings 17 in them (e.g., a slit, slot, etc., that is smaller than the opening that results when the knockout 16 has been removed from the base end 14) that may allow the electrical wires 11 or 12 to be inserted through without the need to punch through the knockouts 16. The knockout 16 may be more than ½ inch in diameter. In one embodiment, one or more of the knockouts 16 allow for the installation therethrough of a non-metallic sheathed cable (as the wires 11). As shown in FIG. 4, one or more of the knockouts 16 may also be positioned on the side wall 13 of the outer casing 3.

In one embodiment, as shown in FIG. 1, the electrical wires 11 received by the outer casing 3 from a power source 10 (e.g. the electrical system of a building or structure) may be connected to the electrical wires 12 of the unified casting 4. As shown, the electrical wires 11 and 12 are connected together through the use of connectors 22 that may be contained within the outer casing 3 (together with the unified casting 4). The term "connector" here is used broadly to not just interlocking or mating connector pairs but also cover wire terminal blocks and wire caps or other devices. In one embodiment, the connectors 22 may be kept outside the outer casing 3 (while the unified casting 4 is retained inside) if the wires 12 are long enough to reach outside of the casing 3. The electrical wires 12 of the unified casting 4 may terminate in a connection with the driver 9 installed within the unified casting 4. When the wires 11 and 12 are connected to each other, electricity may pass from the power source 10 to the driver 9 to enable the driver 9 to power the light source module 8. In one embodiment, the driver 8 has three or more current carrying electrical wires 12.

Figure 6:
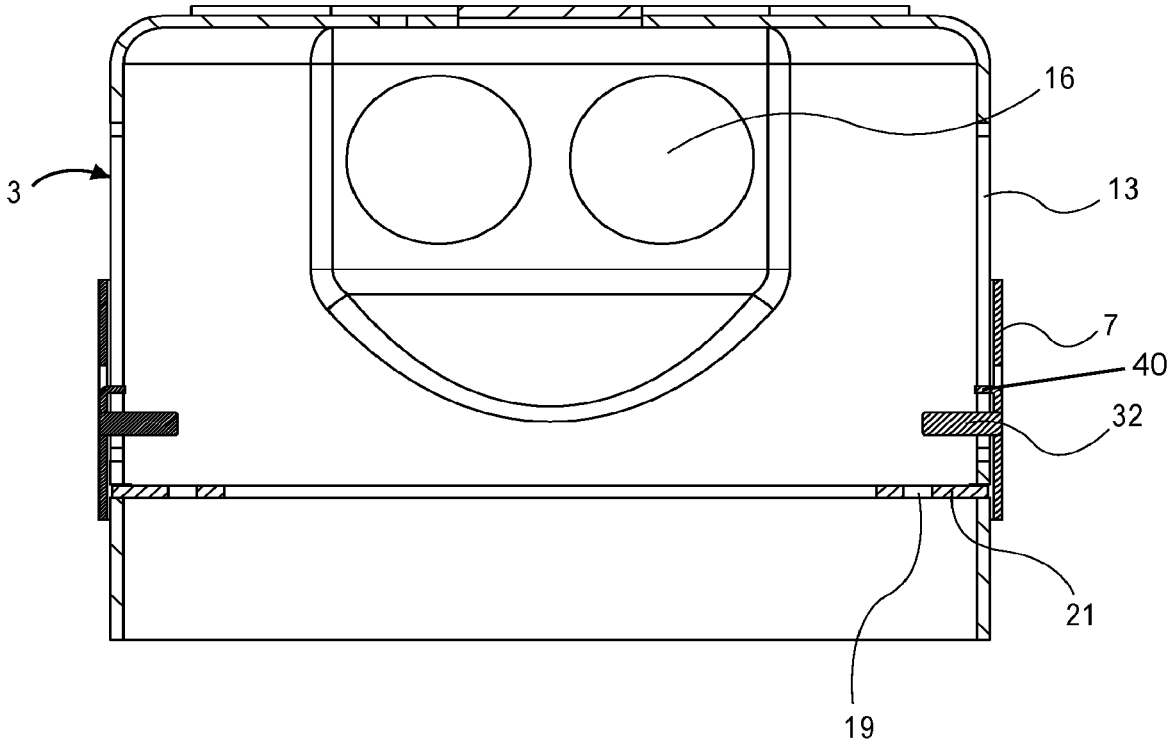
FIG. 6 shows a side cross-section view of an outer casing with hangar holders and a ring according to one embodiment.
Figure 7:
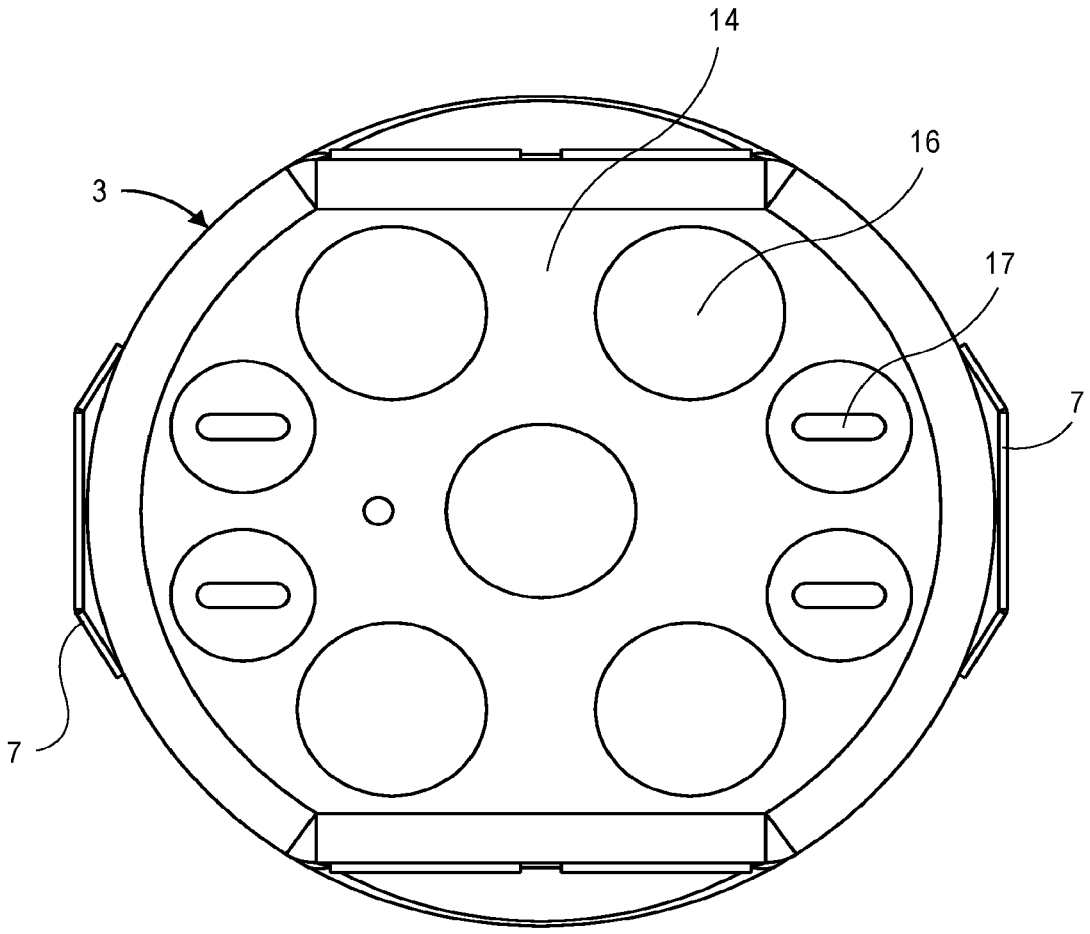
FIG. 7 shows a top view of the embodiment of FIG. 6.

As seen in FIG. 5, the outer casing 3 may have within its cavity 15 a ring 21. The ring 21 maybe shaped as a circle (shown), a polygon, or an ellipsoid, where it conforms to the sidewall 13 of outer casing 3. The ring 21 may be inserted into the cavity 15 of the outer casing 3 through the open end of the side wall 13, and then secured to the inner surface of the side wall 13 of the outer casing 3 as seen in FIG. 6. Once the ring 21 has been secured, the unified casting 4 may be inserted into the cavity 21 (through the same open end of the side wall 13) and then attached to the ring 21 so as to secure the unified casting 4 to the outer casing 3 and prevent the unified casting 4 from falling out of the outer casing. The ring 21 has one or more tabs 18 formed as a flat segment of the ring, each having an opening 19 that passes through the ring 21 (from one face to the other face)—see FIG. 4 and FIG. 6. These are used for coupling (fastening) the outer casing 3 to the unified casting 4—see FIG. 1. In the embodiment of FIG. 4, there are two tabs 18 located diametrically opposite each other (along the circumference of the ring). When the ring 21 is fitted inside the casing 3 (as seen in FIG. 5), each tab 18 may extend inward from and is perpendicular to an inner surface of the side wall 13 of the outer casing 3. Each tab 18 and its opening 19 serves to receive a fastener 20, so as to firmly hold the weight of the unified casting 4 including the light source module 8 and the driver 9 contained in the unified casting 4. The fastener 20 may be a screw, bolt, pin, or the like. In other embodiments, the tabs 18 may incorporate other types of fastening mechanisms (to fasten the unified casting 4 to the outer casing 3), such as a twist-and-lock friction connection that does not require the use of separate tools or other devices. The ring 21 should be affixed inside the cavity so that its tabs 18 may be further recessed inside the cavity 15, towards the base end 14, so that the unified casting 4 and trim 5 may also be further recessed inside the outer casing 3.

In another embodiment, the tab 18 is formed as a portion of the sidewall 13 that has bee bent inward, without the need for a ring 21. In this embodiment, the ring 21 is not necessary, as long as the unified casting 4 can otherwise be secured to the outer casing 3 via the table 18, so as to be prevented from falling out of the outer casing 3.

Figure 8:
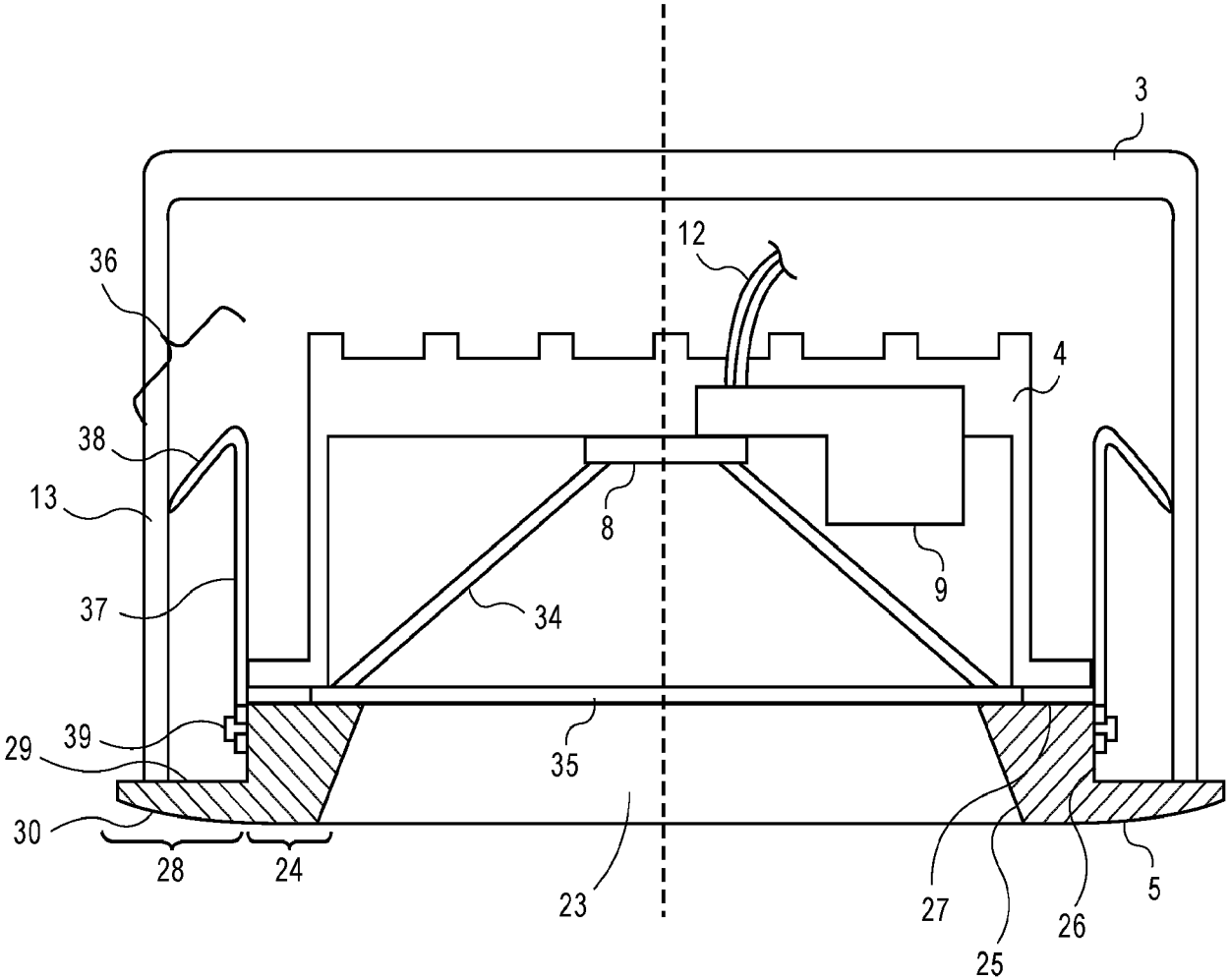
FIG. 8 shows a side cross section view of an outer casing, unified casting, trim, and two friction clips according to one embodiment.

In other embodiments, as shown in FIG. 8, the unified casting 4 may be held inside the outer casing 3, without being directly fastened to any tabs 18. Friction clips 36 (or tension clips) may be utilized to retain the unified casting 4 inside the outer casing 3. Each friction clip 36 may be attached via a screw 39 (or other fastening mechanism such as a bolt, resin, glue, or the like) to a trim base 24 of the trim 5, or directly to the unified casting 4. The friction clip 36 may be flexible and resilient. The friction clip 36 may be a piece of metal that has a straight portion 37 extending from the screw 39 and is then bent backward to form a bent portion 38. The bent portion 38 of the friction clip 36 may directly contact the inner surface of the side wall 13 of the outer casing 3, as shown, preventing the unified casting 4 and the trim 5 from falling out of the outer casing 3.

The unified casting 4 is a shell and/or enclosure that further prevents the exposure of heat from the light source module 8 and the driver 9 to the items inside a ceiling or crawl space (e.g., insulation) in which the recessed lighting fixture 1 has been installed. The unified casting 4 may be formed of metals, polymers, metal alloys, and/or other heat insulating materials. As shown in FIG. 1, the unified casting 4 may be a cylindrical structure; however, in other embodiments, the unified casting 4 may be any suitable shape, including an ellipsoid, cone, or polyhedron that is capable of housing the light source module 8 and the driver 9.

In one embodiment, the unified casting 4 includes one or more heat sinks to dissipate heat generated by the light source module 8 and/or the driver 9. Although the heat sinks are shown as fins (in FIG. 2 and FIG. 8) which are passive components (formed on the outer surface of the end wall and/or the side wall of the unified casting 4) that cool the combined unified casting 4, light source module 8, and driver 9, by dissipating heat into the surrounding air, active heat sinks (e.g., fans) may also be used. In one embodiment, the heat sinks are defined by a set of fins surrounding the unified casting 4, which are formed in the same casting (manufacturing) process that results in the unified casting 4 being formed. The heat sinks may be composed of any thermally conductive material. For example, the heat sinks may be made of aluminium alloys, copper, copper-tungsten pseudoalloy, AlSiC (silicon carbide in aluminium matrix), Dymalloy (diamond in copper-silver alloy matrix), E-Material (beryllium oxide in beryllium matrix), and/or thermally conductive plastics or ceramics.

Still referring to FIG. 8, the recessed lighting fixture 1 may include the driver 9 contained within the unified casting 4. The driver 9 is an electronic circuit or device that supplies and/or regulates electrical energy to the light source module 8 and thus powers the light source module 8 to emit light. The light source module 8 and the driver 9 may be coupled to the end wall of the unified casting 4 as shown in FIG. 8, using any suitable connecting mechanism, including screws, resins, clips, or clamps. The driver 9 may be any type of electrical power supply, including power supplies that deliver an alternating current (AC) or a direct current (DC) voltage to the light source module 8. Upon receiving electricity through the wires 12, the driver 9 may regulate current or voltage to supply a stable voltage or current within the operating parameters of the light source module 8. The driver 9 receives an input current from the power source 10 and may drop the voltage of the input current to an acceptable level for the light source module 8 (e.g., from 120V-277V to 36V-48V). The driver 9 may transfer electrical power to the light source module 8 through an electrical connector (not shown). For example, the driver 9 may deliver electricity to the light source module 8 through an electrical cable (not shown) coupled between the light source module 8 and the driver 9 through removable or permanent connectors or soldered leads originating from the driver 9. The driver 8 may include a magnetic transformer or additional or alternative circuitry for voltage conversion and for regulating the input current or voltage to the light source module 8.

The light source module 8 may be any electro-optical device or combination of devices for emitting light. For example, the light source module 8 may have a single type of light emitting element, as a light emitting diode (LED), organic light-emitting diode (OLED), or polymer light-emitting diode (PLED). In some embodiments, the light source module 8 may have multiple light emitting elements (e.g., LEDs, OLEDs, and/or PLEDs). The light source module 8 receives electricity from the driver 9, as described above, such that the light source module 8 may emit a controlled beam of light into a room or surrounding area. The driver 9 is designed to ensure that the appropriate voltage and current are fed to the light source module 8 to enable the emission of light by the one or more light sources within the light source module 8.

In some embodiments, the recessed lighting fixture 1 may include a reflector 34 contained in the unified casting 4, as shown in FIG. 8. The reflector 34 may surround the entire light source module 8 as shown, or it may surround just a light emitting element of the light source module 8, to adjust the way light emitted by the light source module 8 is directed into a room or surrounding area. In one embodiment, the reflector 34 surrounds the entirety of the light source module 8 and also separates the light source module 8 from the driver 9. This separation allows light from the light source module 8 to be emitted into a room or surrounding area, while shielding the driver 9 from being exposed to the room or surrounding area. For example, in one embodiment, the reflector 34 and the unified casting 4 may together create a sealed structure to shield the driver 9 from the outside environment and the light source module 8. By shielding the driver 9 from the outside environment, the reflector 34 might reduce the risk of fire or other dangers and may help ensure the recessed lighting fixture 1 complies with building and safety codes/regulations. The reflector 34 may be formed of any fire retardant material, including steel, aluminum, metal alloys, calcium silicate, and other similar materials.

The reflector 34 may be formed in any shape that may direct and/or focus light. For example, the reflector 34 may be parabolic or spherical. In one embodiment, the front surface of the reflector 34 may be coated with a reflecting material or include one or more reflecting elements that assists in the adjustment of light emitted by the light source module 8. For example, the reflector 34 may be coated with a shiny enamel or include one or more mirrors or retroreflectors or a microcellular polyethylene terephthalate (MC-PET) material to adjust the focus of light emitted by the light module 8. In other embodiments, the reflector 34 may include various other optic elements to assist in the focusing of light emitted by the light source module 8.

Still referring to FIG. 8, in one embodiment, the recessed lighting fixture 1 may include a lens 35. The lens 35 may be formed to converge or diverge light emitted by the light source module 8. The lens 35 may be a simple lens 35 comprised of a single optical element or a compound lens 35 comprised of an array of simple lenses 35 (elements) with a common axis. In one embodiment, the lens 35 also provides a protective barrier for the light source module 8 and shields the light source module 8 from moisture or inclement weather. The lens 35 may also assist in the diffusion of light and increase the uniformity of light over the surface of the recessed lighting fixture 1. The lens 35 may be made of any at least partially transparent material, including glass and hard plastics. In one embodiment, the lens 35 and the reflector 34 are contained in a single indivisible unit of the unified casting 4, to work in conjunction to focus and adjust light emitted by the light source module 8. In one embodiment, the reflector and the lens are housed together with the driver and the light source module in the unified casting 4 as a single, indivisible unit. In other embodiments, the lens 35 and the reflector 34 may be separate, divisible elements.

Still referring to FIG. 8, in one embodiment, the recessed lighting fixture 1 may include a trim 5. The trim 5 may be attached directly to the unified casting 4 as well as to the outer casing 3 as shown, while in other embodiments the trim 5 is to only be attached to the outer casing 3 (where in that case the unified casting 4 is separately attached to the casing 3, as in FIG. 1 for example). The trim 5 may be attached to the unified casting 4 and/or the outer casing 3 using any suitable connecting mechanism, including resins, clips, screws, bolts, or clamps. In one embodiment, the trim 5 may include grooves and/or slots that are designed to engage with corresponding bumps or tabs of the unified casting 4 and/or the outer casing 3 to form a rotate and lock (or friction lock) connection which prevents axial separation (in FIG. 8, in the vertical or longitudinal direction) of the trim 5 and the outer casing 4, and without the use of separate tools or other devices.

Figure 2:
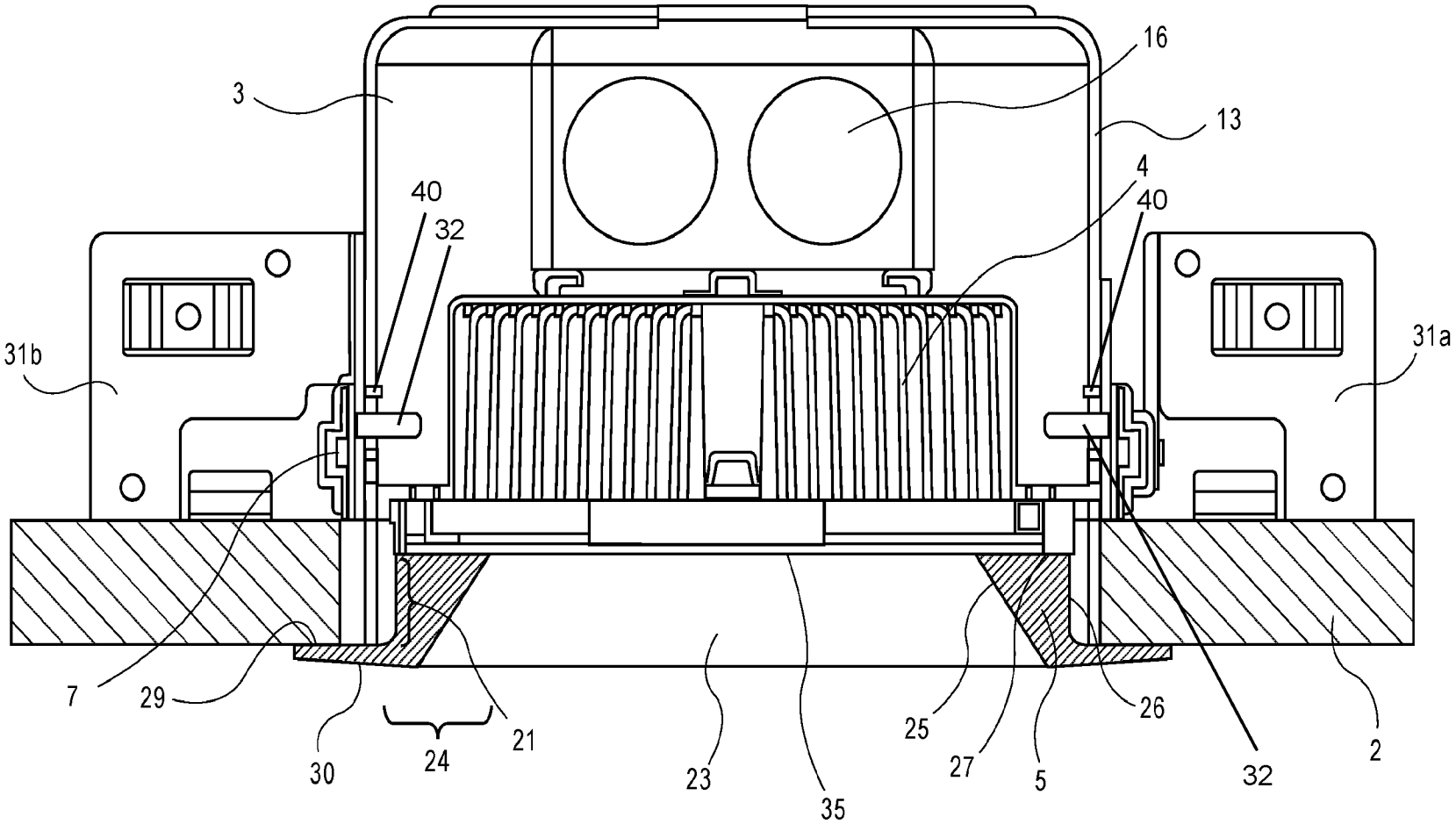
FIG. 2 shows a side cross-section view of the embodiment of FIG. 1.
Figure 3:
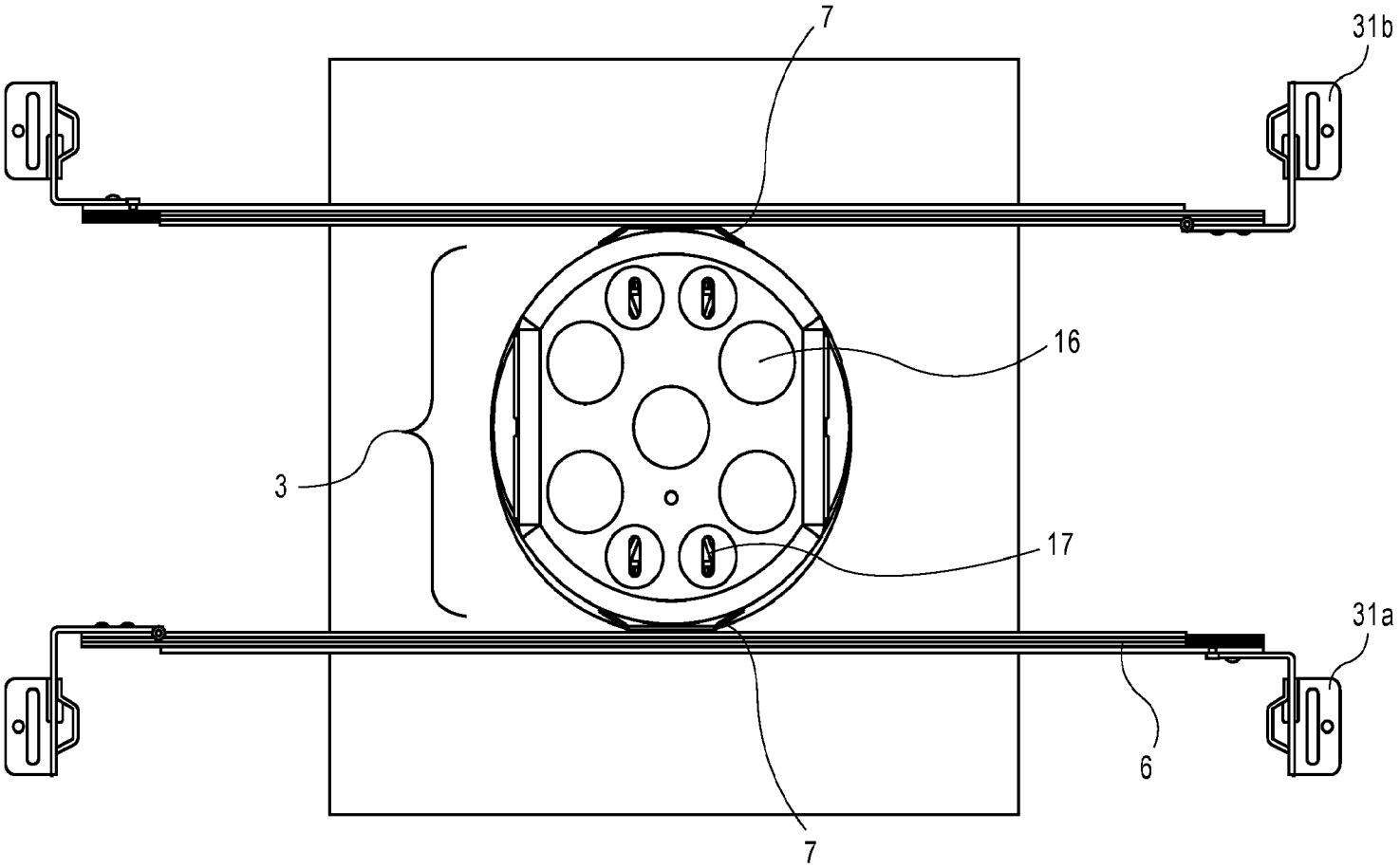
FIG. 3 shows a top view of the embodiment of FIG. 1.

In one embodiment, the entire height 21 of the trim 5, which may or may not be attached to the casting 4, may be inserted into the cavity 15 of the outer casing 3. This is where the unified casting 4 is positioned further (deeper) into the outer casing 3 so that glare from the emitted light is reduced. As seen in FIG. 1 and FIG. 2, for example, the trim 5 may have a trim base 24 (an annular segment) having a height 21, with an inner circumferential surface 25 that is open to the central, light passing aperture 23 and an outer circumferential surface 26 that is closer to the side wall 13 of the outer casing 3. The trim base 24 may have a top surface 27 that extends, in a lateral or horizontal direction, from the inner surface 25 to the outer surface 26 and may be in contact with the lower most surface of the unified casing 4. The height 21 of the trim base 24 may be increased so as to position the lens 35 further into the outer casing 3. It is preferred that the height 21 of the trim base 24 is less than. The trim 5 may have a flange 28 that extends laterally outward from the base 24, with a top surface 29 and a bottom surface 30 as shown. In one embodiment, referring now back to FIG. 1, the trim base 24 may be shaped and sized such that the outer surface 26 thereof conforms to an inner surface of the side wall 13 of the outer casing 3 so that the trim 5 and the outer casing 3 are in direct contact. In one embodiment, the trim 5 may be fitted tightly to the side wall 13 of the outer casing 3 (friction fit) so that the trim 5 does not fall out of the outer casing 3 (when the trim 5 is not also separately attached to the unified casting 4). In another embodiment, the outer surface 26 of the trim base 24 of the trim 5 may be attached to the inner surface of the side wall 13 of the outer casing 3 through any connecting mechanism. The trim 5 may be pushed into the outer casing 3 so that the bottom end or edge of the side wall 13 of the outer casing 3 comes into direct contact with the top surface 29 of the flange 28 of the trim 5, for a tight, snug fit as shown in FIGS. 1 and 2. However, it is not necessary for the end of the side wall 13 of the outer casing 3 to directly contact the top surface 29 of the flange 28 of the trim 5. In yet another embodiment, the outer surface 26 of the trim base 24 need not contact the inner surface of the side wall 13 of the outer casing 3 (e.g., when friction clips 36 are used as shown in FIG. 8).

In one embodiment, different diameter trims 5 may be capable of being coupled to the same unified casting 4 and/or the same outer casing 3, where the diameter is measured at the periphery of the flange 28. The size and design of the trims 5 may depend on the size of the hole the wall 2 in which the recessed lighting fixture 1 has been fitted to conceal the exposed wall or ceiling edge that defines the hole. The recessed lighting system 1 may include two or more trims 5 of different sizes to cover ceiling or wall openings of different sizes. The trim 5 may need to meet the aesthetic demands of the consumer. The trim 5 may be made of aluminum plastic polymers, alloys, copper, copper-tungsten pseudoalloy, AlSiC (silicon carbide in aluminum matrix), Dymalloy (diamond in copper-silver alloy matrix), and E-Material (beryllium oxide in beryllium matrix).

In one embodiment, the recessed lighting fixture 1 may include a set of hangar bars 6 as shown in FIG. 1. The hangar bars 6 may be rigid, elongated members that are connected to adjacent joists and/or beams in the walls or ceilings of a structure. In one embodiment, each of the hangar bars 6 may be telescoping such that each hangar bar 6 may be extended or retracted to meet the gap between the joists and/or beams. In one embodiment, each of the hangar bars 6 may include a set of mounting blocks 31. The mounting blocks 31 may be used to directly attach the hangar bars 6 to the joists and/or beams in the walls or ceilings of a structure. For example, as shown in FIG. 1, the mounting blocks 31 may include holes for receiving screws and/or nails or other fasteners that enable the hangar bars 6 to be securely attached to a building structure. Although shown in FIG. 1 and described above in relation to holes and screws, in other embodiments, other mechanisms of attachment may be used in conjunction with the mounting blocks 31, including resins, clips, or clamps to attached the bars 6 to the building structure. In one embodiment, the mounting blocks 31 may be integrated in one indivisible structure along with the hangar bars 6, while in other embodiments, as shown in FIG. 1, the mounting blocks 31 may be coupled to the hangar bars 6 through the use of one or more attachment mechanisms (e.g., screws, bolts, resins, clips, or clamps). Using the above telescoping and mounting features, the recessed lighting fixture 1 may be installed in almost all the 2"×2" through 2"×18" wood joist constructions, metal stud constructions, and t-bar ceiling constructions.

In one embodiment, referring back to FIG. 3, the recessed lighting fixture 1 may have a mounting mechanism that includes a set of hangar holders 7 (two are shown) that couple the outer casing 3 to the hangar bars 6, respectively. The hangar holder 7 may be a plate that is configured to slide substantially horizontally or otherwise move along the length of a corresponding hangar bar 6 that has a fixed length. Alternatively, the hangar holder 7 may be fixed to a telescoping section of the hangar bar (having a variable length).

FIG. 4 shows a perspective view of the hangar holder 7 according to one embodiment. The hangar holder 7 has an attachment mechanism 32 for coupling with the outer casing 3, so that the outer casing 3 can be coupled to a hangar bar 6, as seen in FIG. 6. The attachment mechanism 32 may be a pin attached to and extending inward from the inner face of the plate of hangar holder 7. The attachment mechanism 32 may be inserted into an elongated opening 33 (e.g. slot, slit, etc.) in the side wall 13 of the outer casing 3. The hangar holder 7 may also include a tab 40 located near the attachment mechanism 32 that is inserted into the opening 33. The opening 33 may be vertically or substantially vertically oriented (parallel to the direction of the wall thickness 18, or perpendicular to the longitudinal axis of the hangar bar 6—see FIG. 1) so that when the outer casing 3 is coupled to the hangar holder 7, the outer casing 3 may be moved up or down as desired (while restricted in the sideways or lateral direction due to the attachment mechanism 32 being captured within the elongated opening 33). The outer casing 3 may be moved along the length of the elongated opening 33 before being locked in a particular position. It is preferred that the elevation of the casing 3 behind the ceiling or wall 2 be adjusted in this manner so that the flange 28 of the trim 5 is flush with the ceiling or wall 2 as seen in FIG. 1

In another embodiment, the attachment mechanism 32 may be a screw that couples the hangar holder 7 to the outer casing 3. When the screw is inserted into the opening 33 of the outer casing 3 and turned, the outer casing 3 may move up or down relative to the hangar bar 6 depending on the direction the screw is turned. Accordingly, the outer casing 3, along with the light source module 8 and the driver 9, may be moved and adjusted so that the flange 28 is flush or sufficiently close to the ceiling or wall during installation. In yet another embodiment, the location of the attachment mechanism 32 and the elongated opening 33 are reversed, so that the opening 33 is formed in the hangar holder 7 rather than in the side wall 13 of the outer casing 3, and the attachment mechanism 32 is affixed to and extending outward from the outside surface of the sidewall 13 of the casing 3.

By being moveably coupled to the hangar holders 7, the outer casing 3, along with the light source module 8 and the driver 9 therein, may be moved in a length direction of the hangar bars 6 to a desired location. The outer casing 3 may also be moved substantially vertically relative to the hangar bars 6. For example, the outer casing 3 may be adjusted vertically more than one inch upwards and one inch downwards. The hangar holders 7 may then be fixed to the hangar bars 6 so that they no longer move substantially horizontally or vertically relative to the hangar bars 6.

As described above, the combination of a hangar bar 6 and a hangar holder 7 allows the outer casing 3 to be moved in a direction parallel to a longitudinal axis of the hangar bar 6, as well as in a direction not parallel (e.g., perpendicular) to the hangar bar 6. Accordingly, the outer casing 3 may be moved to a preferred location between a set of joists or beams in a structure and at a desired height before the being locked into position using the attachment mechanism 32. The unified casting 4 is then positioned inside the outer casing 3, by being inserted into the cavity 15 through the opening defined by the lower end, edge or periphery of the side wall 13. By being configured such that the outer casing 3, along with the light source module 8 and the driver 9 therein, is coupled to a unified set of moveable elements that assist in positioning the combined structure, the recessed lighting fixture 1 eliminates the added bulk and size of traditional recessed lighting fixtures. In particular, the recessed lighting fixture 1 allows adjustment of the position of the light source module 8 between joists or beams, without the need for both a compartment or can that is dedicated to housing the light source module 8 and a separate compartment that is dedicated to housing the driver 9. Instead, the light source module 8 may be housed along with the driver 9 in the same cavity 15 of the outer casing 3, where the latter itself can be directly moved to a desired position. This compact design provides an affordable design by cutting the cost of raw materials and other components and reduces shipping costs by reducing bulk. Also, by having the driver 9 and the light source module 8 placed in the same cavity of the outer casing 3, serviceability and replacement of the driver 9 will be easier to perform and more convenient. In contrast, traditional housings have the driver 9 mounted on the outer casing 3 and contractors are forced to spend a significant amount of time removing parts to gain access to the outer casing 3 and the driver 9.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

The invention claimed is:

1. An apparatus, comprising:

an outer casing having a cavity to contain a light source module and a driver for the light source module, the outer casing comprising:

a base end whose largest extension defines a base end plane;

a sidewall joined to the base end and extending perpendicular to the base end plane such that the sidewall and the base end together define the cavity; and a ring, disposed within the cavity and coupled to the sidewall of the outer casing, to couple at least the light source module, when present in the lighting fixture, to the outer casing, wherein:

at least a portion of an exterior of the sidewall has a substantially cylindrical shape;

the exterior of the sidewall comprises two diametrically opposed flat portions that start at and extend from the base end; and at least one flat portion of the two diametrically opposed flat portions includes at least one knockout.

2. A lighting fixture, comprising:

the apparatus of claim 1; and the light source module and the driver disposed in the cavity of the outer casing wherein, during operation, the light source module emits light and the driver regulates electrical energy to the light source module.

3. The lighting fixture of claim 2, wherein:

at least the light source module is contained in a housing disposed in the cavity of the outer casing;

the housing includes a first opening;

the ring includes a tab having a second opening that aligns with the first opening of the housing; and the lighting fixture further comprises:

a fastener, inserted through the first opening of the housing and the second opening of the ring, to couple the housing to the ring.

4. The lighting fixture of claim 2, wherein:

at least the light source module is contained in a housing disposed in the cavity of the outer casing;

the sidewall of the outer casing has an edge defining an opening into the cavity of the outer casing; and the lighting fixture further comprises:

a trim, coupled to at least one of the housing or the outer casing, to cover the edge of the sidewall of the outer casing.

5. The lighting fixture of claim 2, wherein:

at least the light source module is contained in a housing disposed in the cavity of the outer casing;

the outer casing includes at least one knockout; and the outer casing serves as a junction box to contain both of the housing and a non-metallic sheathed cable inserted through an opening formed on the outer casing by the removal of the at least one knockout in the outer casing, the non-metallic sheathed cable being coupled to an external power distribution system to supply at least one of 120 VAC or 277 VAC power to the driver disposed in the cavity of the outer casing.

6. The apparatus of claim 1, wherein the outer casing further comprises:

a first knockout disposed on the base end; and a second knockout disposed on the base end having a different size than the first knockout.

7. The apparatus of claim 1, wherein:

the sidewall of the outer casing has an edge defining an opening into the cavity of the outer casing; and the outer casing has an outside height, defined between the base end and the edge of the sidewall, that is less than 5 inches.

8. An apparatus, comprising:

the outer casing of claim 1;

a first hangar bar assembly coupled to the outer casing, the first hangar bar assembly comprising:

a first hangar holder coupled to the sidewall of the outer casing; and a first pair of telescopically slidable hangar bars slidably coupled to the first hangar holder; and a second hangar bar assembly coupled to the outer casing, the second hangar bar assembly comprising:

a second hangar holder coupled to the sidewall of the outer casing; and a second pair of telescopically slidable hangar bars slidably coupled to the second hangar holder.

9. An apparatus, comprising:

an outer casing, comprising:

a base end whose largest extension defines a base end plane;

a sidewall joined to the base end and extending perpendicular to the base end plane such that the sidewall and the base end together define a cavity, the sidewall having an edge defining an opening into the cavity of the outer casing, wherein at least an inner portion of the sidewall, proximate to the edge defining the opening of the cavity, has a circular shape;

a first hangar bar assembly coupled to the outer casing, the first hangar bar assembly comprising:

a first hangar holder coupled to the sidewall of the outer casing; and a first pair of telescopically slidable hangar bars slidably coupled to the first hangar holder; and a second hangar bar assembly coupled to the outer casing, the second hangar bar assembly comprising:

a second hangar holder coupled to the sidewall of the outer casing; and a second pair of telescopically slidable hangar bars slidably coupled to the second hangar holder, wherein:

at least a portion of an exterior of the sidewall has a substantially cylindrical shape;

the exterior of the sidewall comprises two diametrically opposed flat portions that start at and extend from the base end; and at least one flat portion of the two diametrically opposed flat portions includes at least one knockout.

10. The apparatus of claim 9, wherein the outer casing further comprises:

a first knockout disposed on the base end; and a second knockout disposed on the base end having a different size than the first knockout.

11. The apparatus of claim 10, wherein:

the outer casing has an outside height, defined between the base end and the edge of the sidewall, that is less than 5 inches.

12. The apparatus of claim 9, wherein:

the outer casing has an outside height, defined between the base end and the edge of the sidewall, that is less than 5 inches.

13. A lighting fixture, comprising:

the outer casing of claim 9;

a light source module disposed in the cavity of the outer casing; and a driver, disposed in the cavity of the outer casing, to regulate electrical energy to the light source module.

14. The lighting fixture of claim 13, further comprising:

a ring, disposed in the cavity of the outer casing and coupled to the sidewall, to couple at least the light source module to the outer casing; and a trim, coupled to at least one of the light source module or the outer casing, to cover the edge of the sidewall of the outer casing.

15. The lighting fixture of claim 13, further comprising:

a trim, coupled to the light source module and coupled to the outer casing, to cover the edge of the sidewall of the outer casing, wherein the light source module does not physically contact the sidewall and the base end of the outer casing.

16. The lighting fixture of claim 13, wherein the outer casing serves as a junction box to contain the light source module, the driver, and a non-metallic sheathed cable inserted through an opening formed on the outer casing by the removal of a knockout in the outer casing, the non-metallic sheathed cable being coupled to an external power distribution system to supply at least one of 120 VAC or 277 VAC power to the driver contained in the housing.

17. An outer casing, comprising:

a base end whose largest extension defines a base end plane;

a sidewall coupled to the base end and extending perpendicular to the base end plane such that the sidewall and the base end together define a cavity, the sidewall comprising:

a first flat portion of the sidewall abutting the base end; and a second flat portion of the sidewall abutting the base end and located diametrically opposite from the first flat portion, wherein:

at least a portion of an exterior of the sidewall has a substantially cylindrical shape;

the sidewall of the outer casing has an edge defining an opening into the cavity of the outer casing;

the outer casing has an outside height, defined between the base end and the edge of the sidewall, that is greater than 2½ inches and less than 5 inches; and at least one of the first flat portion and the second flat portion includes at least one knockout.

18. The outer casing of claim 17, further comprising:

a first knockout on the first flat portion of the sidewall;

a second knockout on the second flat portion of the sidewall; and a third knockout on the base end, wherein the first knockout, the second knockout, and the third knockout are substantially similar in shape and dimensions.

19. The outer casing of claim 17, wherein the sidewall includes an interior curved portion defining a portion of the cavity.

20. The outer casing of claim 19, wherein the interior curved portion of the sidewall is cylindrical in shape.

21. An apparatus, comprising;
the outer casing of claim 17;
a first hangar bar assembly coupled to the outer casing, the first hangar bar assembly comprising a first pair of telescopically slidable hangar bars; and
a second hangar bar assembly coupled to the outer casing, the second hangar bar assembly comprising a second pair of telescopically slidable hangar bars.

22. An apparatus, comprising:
the outer casing of claim 17; and
a ring, disposed in the cavity of the outer casing and coupled to at least a portion of the sidewall, the ring having a substantially circular shape.

23. A lighting fixture, comprising:
the outer casing of claim 17;
a housing, disposed in the cavity of the outer casing, the housing comprising a plurality of fins for cooling and containing a light source module to emit light; and
a driver to regulate electrical energy to the light source module.

24. The lighting fixture of claim 23, wherein the housing does not physically contact the sidewall and the base end of the outer casing.

25. The lighting fixture of claim 23, further comprising:
a trim, directly attached to the housing via one or more screws and coupled to the outer casing via one or more friction clips, to cover the edge of the sidewall of the outer casing.

26. The lighting fixture of claim 25, wherein:
the sidewall of the outer casing includes an interior curved portion defining a portion of the cavity; and
the one or more friction clips physically contacts the interior curved portion of the sidewall of the outer casing.

27. The lighting fixture of claim 23, further comprising:
electrical wires inserted through an opening on the sidewall of the outer casing and electrically coupled to an external power distribution system to supply at least one of 120 VAC or 277 VAC power to the driver.

28. The lighting fixture of claim 23, further comprising:
electrical wires, disposed in the cavity of the outer casing and electrically coupled to the driver, wherein the electrical wires comprise at least one interlocking connector.

29. The outer casing of claim 17, further comprising:
an attachment mechanism, inserted through an opening of the sidewall, to couple the outer casing to a mounting mechanism.

30. An apparatus, comprising:
the outer casing of claim 29; and
the mounting mechanism, wherein the mounting mechanism comprises:
a hangar holder, coupled to the attachment mechanism, that is translationally movable with respect to the outer casing and not rotationally movable with respect to the outer casing.

31. The apparatus of claim 30, further comprising:
a first hangar bar slidably coupled to the mounting mechanism;
a second hangar bar slidably coupled to the mounting mechanism and telescopically slidable with respect to the first hangar bar;
a first mounting block coupled to the first hangar bar; and
a second mounting block coupled to the second hangar bar,
wherein the first mounting block and the second mounting block each include attachment features to couple to at least one of a wood joist or a t-bar.

32. An apparatus, comprising:
an outer casing comprising:
a base end;
a sidewall coupled to the base end such that the sidewall and the base end together define a cavity, the sidewall comprising an edge defining an opening into the cavity, an interior cylindrical portion of the sidewall defining a portion of the cavity, the sidewall comprising:
a first flat portion of the sidewall abutting the base end; and
a second flat portion of the sidewall abutting the base end and located diametrically opposite from the first plat portion of the sidewall;
a first knockout on the first flat portion;
a second knockout on the second flat portion; and
a third knockout on the base end;
a first hangar bar assembly directly coupled to the outer casing, the first hangar bar assembly comprising:
a first hangar holder, coupled to the sidewall of the outer casing via a first attachment mechanism; and
a first pair of telescopically slidable hangar bars slidably coupled to the first hangar holder, each hangar bar in the first pair of telescopically slidable hangar bars having a mounting block; and
a second hangar bar assembly directly coupled to the outer casing, the second hangar bar assembly comprising:
a second hangar holder, coupled to the sidewall of the outer casing via a second attachment mechanism; and
a second pair of telescopically slidable hangar bars slidably coupled to the second hangar holder, each hangar bar in the second pair of telescopically slidable hangar bars having a mounting block;
wherein:
the outer casing has an outside height, defined between the base end and the edge of the sidewall, less than 5 inches;
the first knockout, the second knockout, and the third knockout each have a diameter greater than 0.5 inches;
the first hangar holder and the second hangar holder are each translationally movable with respect to the outer casing and not rotationally movable with respect to the outer casing;
the first hangar holder is physically decoupled from the second hangar holder such that the translational movement of the first hangar holder with respect to the outer casing is independent of the translational movement of the second hangar holder with respect to the outer casing; and
the mounting block of each hangar bar in the first pair of telescopically slidable hangar bars and the second pair of telescopically slidable hangar bars has attachment features to couple to at least one of a wood joist or a t-bar.

33. The apparatus of claim 32, wherein the outer casing, the first hangar holder of the first hangar bar assembly, and the second hangar holder of the second hangar bar assembly are arranged and shaped to be mirror symmetric about a plane that bisects the outer casing, the first hangar holder, and the second hangar holder.

34. A lighting fixture, comprising:

the apparatus of claim 32;

a driver to regulate electrical energy to the light source module;

a housing having a second sidewall with a plurality of fins for cooling;

a light source module to emit light;

a trim, directly attached to the housing via one or more screws and coupled to the outer casing via one or more friction clips, to cover the edge of the sidewall of the outer casing, the one or more friction clips physically contacts the interior cylindrical portion of the sidewall of the outer casing; and electrical wires, inserted through a second opening on the sidewall of the outer casing formed by the removal of a knockout substantially similar to the first, second, and third knockouts and electrically coupled to an external power distribution system to supply at least one of 120 VAC or 277 VAC power to the driver.

35. A lighting kit, comprising:

an outer casing, comprising:

a base end whose largest extension defines a base end plane;

a sidewall coupled to the base end and extending perpendicular to the base end plane such that the sidewall and the base end together define a cavity, the sidewall comprising:

a first flat portion of the sidewall abutting the base end; and a second flat portion of the sidewall abutting the base end and located diametrically opposite from the first flat portion, wherein:

the sidewall of the outer casing has an edge defining an opening into the cavity of the outer casing; and the outer casing has an outside height, defined between the base end and the edge of the sidewall, that is greater than 2½ inches and less than 5 inches;

a first hangar bar assembly coupled to the outer casing, the first hangar bar assembly comprising:

a first hangar holder coupled to the sidewall of the outer casing; and a first pair of telescopically slidable hangar bars slidably coupled to the first hangar holder;

a second hangar bar assembly coupled to the outer casing, the second hangar bar assembly comprising:

a second hangar holder coupled to the sidewall of the outer casing; and a second pair of telescopically slidable hangar bars slidably coupled to the second hangar holder;

a light source module and a driver for placement in the cavity of the outer casing wherein, during operation, the light source module emits light and the driver regulates electrical energy to the light source module; and a trim for coupling to at least one of the outer casing and the light source module to cover the edge of the sidewall of the outer casing.

36. The lighting kit of claim 35, wherein at least a portion of an exterior of the sidewall has a substantially cylindrical shape.

37. The lighting kit of claim 35, wherein at least an inner portion of the sidewall, proximate to the edge defining the opening of the cavity, has a circular shape.

38. The lighting kit of claim 35, wherein at least one of the first flat portion of the sidewall and the second flat portion of the sidewall includes at least one knockout.

39. The lighting kit of claim 35, wherein the outer casing further comprises a plurality of knockouts disposed on the base end.

40. The lighting kit of claim 35, wherein the outer casing further comprises a ring to couple at least the light source module to the outer casing.

* * * * *